US007987646B2

(12) United States Patent
Race et al.

(10) Patent No.: US 7,987,646 B2
(45) Date of Patent: Aug. 2, 2011

(54) POLYMERIC OR COMPOSITE WALL AND SURFACE VENEERING PRODUCTS, SYSTEMS AND METHODS OF USE THEREOF

(75) Inventors: Robert J Race, Eagan, MN (US); Paul J. Forsberg, Windermere, FL (US); Edward Alan Knudson, Annandale, MN (US); John Fitzgerald Dolan, Golden Valley, MN (US); Daryl Pilarski, East Bethel, MN (US); Joel Forsberg, Shakopee, MN (US)

(73) Assignee: New Technology Resources, Inc., Edina, MN (US)

( * ) Notice: Subject to any disclaimer, the term of this patent is extended or adjusted under 35 U.S.C. 154(b) by 587 days.

(21) Appl. No.: 11/872,812

(22) Filed: Oct. 16, 2007

(65) Prior Publication Data

US 2009/0068406 A1 Mar. 12, 2009

Related U.S. Application Data

(60) Provisional application No. 60/829,925, filed on Oct. 18, 2006, provisional application No. 60/953,040, filed on Jul. 31, 2007.

(51) Int. Cl.
*E04B 2/02* (2006.01)
*E04B 2/72* (2006.01)

(52) U.S. Cl. ..... 52/506.01; 52/518; 52/519; 52/536; 52/539; 52/547; 52/506.04; 52/506.06; 52/507; 52/429; 52/415

(58) Field of Classification Search ..... 52/518–560, 52/309.1, 309.2, 309.4–309.6, 309.8, 309.14, 52/415–454, 506.01, 506.03, 506.04, 508–510, 52/513; 525/309.5
See application file for complete search history.

(56) References Cited

U.S. PATENT DOCUMENTS

| | | | | |
|---|---|---|---|---|
| 2,100,505 | A * | 11/1937 | Gimeno | 52/277 |
| 3,311,520 | A * | 3/1967 | Michaelson et al. | 156/209 |
| 3,504,467 | A * | 4/1970 | Caulfield et al. | 52/309.1 |
| 5,885,502 | A | 3/1999 | DeAngelis et al. | |
| 6,324,807 | B1 * | 12/2001 | Ishiko | 52/506.01 |
| 6,350,498 | B1 | 2/2002 | Hess et al. | |
| 2005/0188642 | A1 | 9/2005 | Correia | |
| 2006/0026919 | A1 | 2/2006 | Morse et al. | |

FOREIGN PATENT DOCUMENTS

| | | |
|---|---|---|
| AT | 311635 | * 11/1973 |
| CH | 358926 | * 12/1961 |
| DE | 951689 | * 3/1964 |
| DE | 8518352 | * 8/1985 |
| EP | 0892125 | * 1/1999 |
| EP | 1400641 | * 3/2004 |

(Continued)

*Primary Examiner* — Jeanette E. Chapman
(74) *Attorney, Agent, or Firm* — Fredrikson & Byron, PA

(57) ABSTRACT

The present invention relates to wall and surface veneering products and systems that provide a replica image of a natural surface, such as stone, brick or wood, and is easily installable due to its lightweight characteristics and securement design. The present invention further includes systems for attachment of the veneering product to walls or other surfaces and also includes systems for assembling such products to provide pleasing arrangements and complete wall coverage. The present invention also includes methods of manufacture, which ensures the natural appearance of stone or wood by imaging a natural surface, such as stone or wood, and preparing a mold from that image to mass produce a replica of that particular surface.

14 Claims, 31 Drawing Sheets

FOREIGN PATENT DOCUMENTS

| | | | |
|---|---|---|---|
| FR | 2079515 | | 11/1971 |
| FR | 2712013 | * | 5/1995 |
| GB | 1156654 | * | 7/1969 |
| JP | 09111902 | * | 4/1997 |
| WO | 2004018798 | * | 3/2004 |
| WO | 2005108683 | * | 11/2005 |

* cited by examiner

POLYMERIC OR COMPOSITE WALL AND SURFACE VENEERING PRODUCTS, SYSTEMS AND METHODS OF USE THEREOF

CROSS-REFERENCE TO RELATED APPLICATION

This application claims priority to U.S. Provisional Application Ser. No. 60/829,925, filed on Oct. 18, 2006, and U.S. Provisional Application No. 60/953,040 filed on Jul. 31, 2007. The contents of the three previously mentioned applications are incorporated by reference herein.

FIELD OF THE INVENTION

The present invention relates to wall and surface veneering products and systems that provide a replica image of a natural surface, such as stone, brick or wood, and is easily installable due to its lightweight characteristics and securement design. The present invention further includes systems for attachment of the veneering product to walls or other surfaces and also includes systems for assembling such products to provide pleasing arrangements and complete wall coverage. The present invention also includes methods of manufacture, which ensures the natural appearance of stone or wood by imaging a natural surface, such as stone or wood, and preparing a mold from that image to mass produce a replica of that particular surface.

BACKGROUND OF THE INVENTION

Even though the use of the actual natural materials (e.g. cut stone, brick or wood) is common in the construction industry, such products have produced challenges that have caused problems related to transportation and installation. For example, the utilization of natural stone, concrete, brick or wood can be cumbersome during transportation and installation of such products due to their heavy weight and the difficulties in easily attaching such products to each other or to the surface of a substrate such as a wall or panel. Furthermore, stone (natural or cultured), concrete and wood products often discolor, stain or degrade over time, thereby damaging their aesthetic appearance and ultimately requiring their replacement.

The construction industry and home improvement product manufacturers have found difficulties in manufacturing products utilizing materials such as plastic, fiberglass, ceramics and the like that simulate cut stone, brick or wood. Such products have not been able to adequately capture the desired look found in their natural counterparts and in many of these products, have been less that durable. For example, such products often do not have the proper combination of texture, relief and color that would lead an observer to believe it was the natural product rather than a poor simulation. The industry still searches for a construction or resurfacing product that is lightweight, easily installable, consistently durable, provides stunning natural aesthetics and maintains its natural appearance for long periods of time.

SUMMARY OF THE INVENTION

Embodiments of the present invention relate to polymeric or composite wall and surface veneering products and the methods of use and manufacture for such products. The veneering products of the present invention also are produced with one or more materials (e.g. thermoplastics, thermosets, fiberglass, ceramics . . . ) that are resistant to damage and wear caused by the environment, such as sunlight, water, pest infestation and staining from dirt or other organic materials. In various embodiments of the present invention, the utilization of polymers (e.g. high density polyethylene, polypropylene and the like), that are processed using structural foam and other foamed polymer techniques produce wall veneering products that have desirable textures and relief, but still provide incredibly robust and sturdy structural characteristics. Moreover, such structural foam and/or foamed polymer products also accommodate further fabrication of their exposed surfaces, thereby providing the desired texture and color of the natural product, such as stone or wood. The veneering products of the present invention are generally light weight and provide a beneficial alternative to other wall coverings, such as natural or cultured stone, brick, wood and the like.

BRIEF DESCRIPTION OF THE DRAWINGS

FIG. 15*b* is a side view of one embodiment of a panel of a polymeric veneering system of the present invention that is adjoined to a wall or substrate with a radius clip.

DETAILED DESCRIPTION OF THE INVENTION

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

Figure 1:
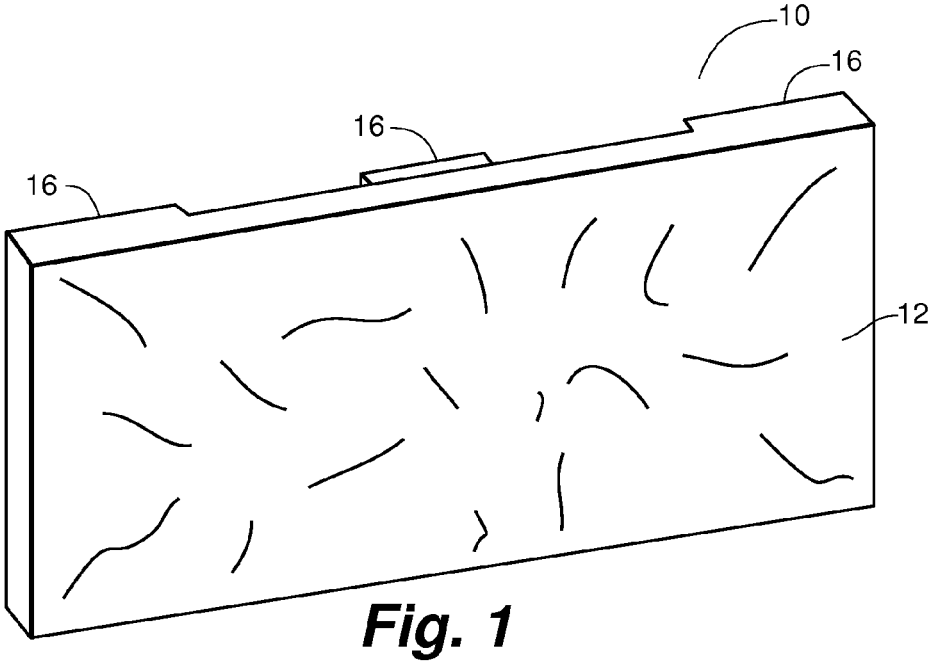
FIG. 1 is a front perspective view of one embodiment of a front surface of a polymeric veneering product of the present invention.
Figure 2:
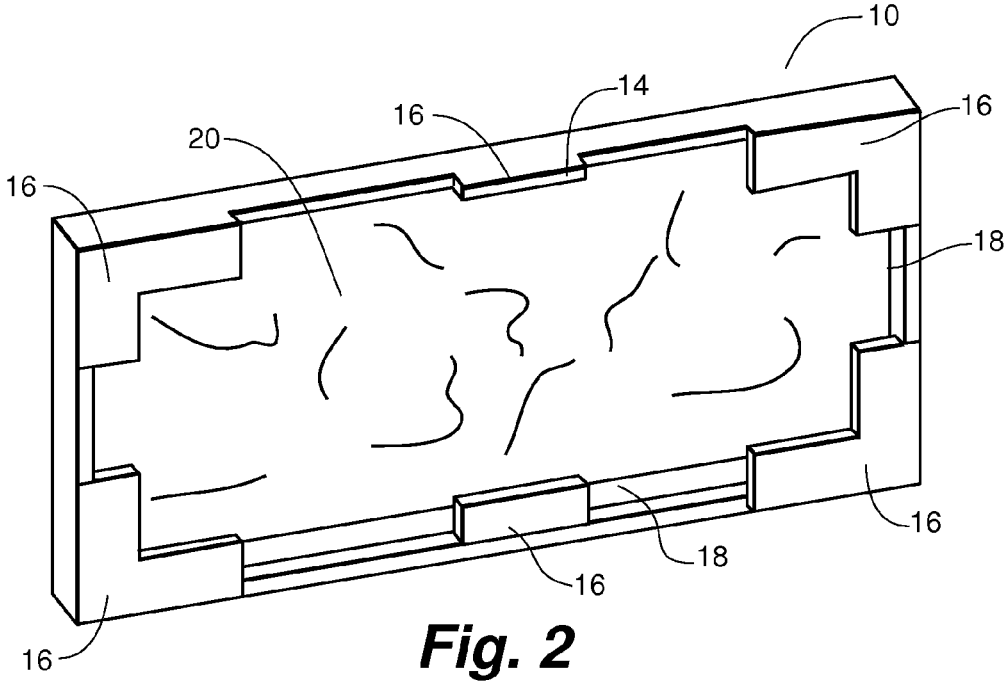
FIG. 2 is a front perspective view of one embodiment of a back surface of a polymeric veneering product of the present invention.

FIGS. 1 and 2 depict one embodiment of the polymeric or composite veneering product of the present invention comprising a veneering panel 10 including a front surface 12 having relief and/or texture and a back surface 14 having one or more attachment platforms 16 for securing the veneering panel 10 to a surface. It is noted that the attachment platforms 16 may be alternatively adjoined to the sides of the panel 10 rather than positioned on the back surface 14 depending on the type of attachment means or panel designs. The front surface 12 of the veneering product may comprise one or more colors, textures, degrees of relief and/or designs. For example, as depicted in FIG. 1, one embodiment of the veneering panel 10 may appear as a single cut stone. In many embodiments of the present invention, the front surface design is obtained by imaging a natural surface, such as stone, rock, wood or brick. Imaging a natural surface provides a panel that simulates the natural surface and give the most aesthetic appearance. An explanation of imaging is provides below.

Figure 3:
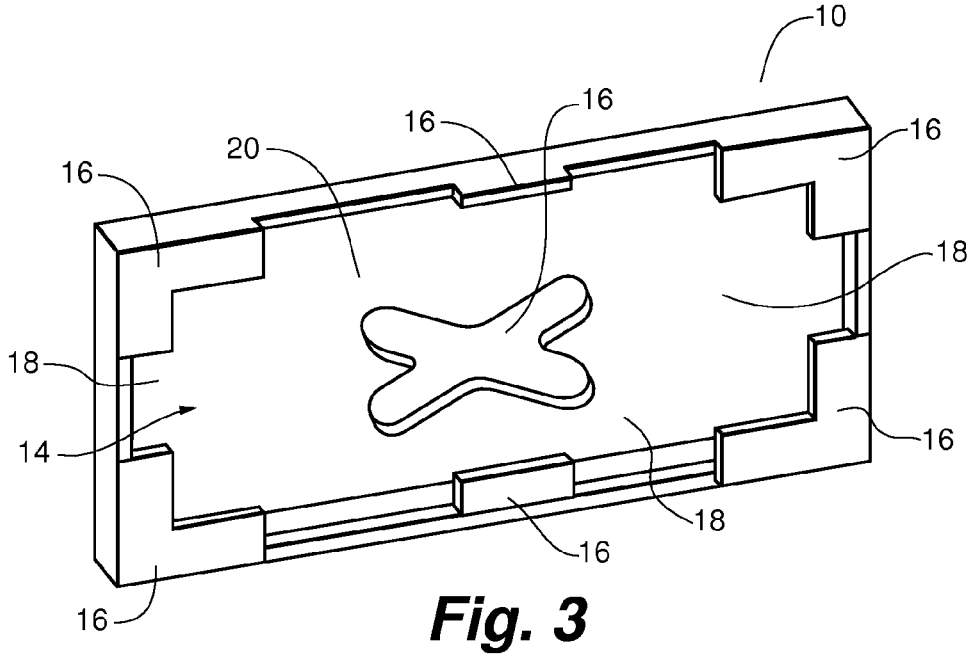
FIG. 3 is a front perspective view of one embodiment of a back surface of a polymeric veneering product of the present invention.
Figure 4:
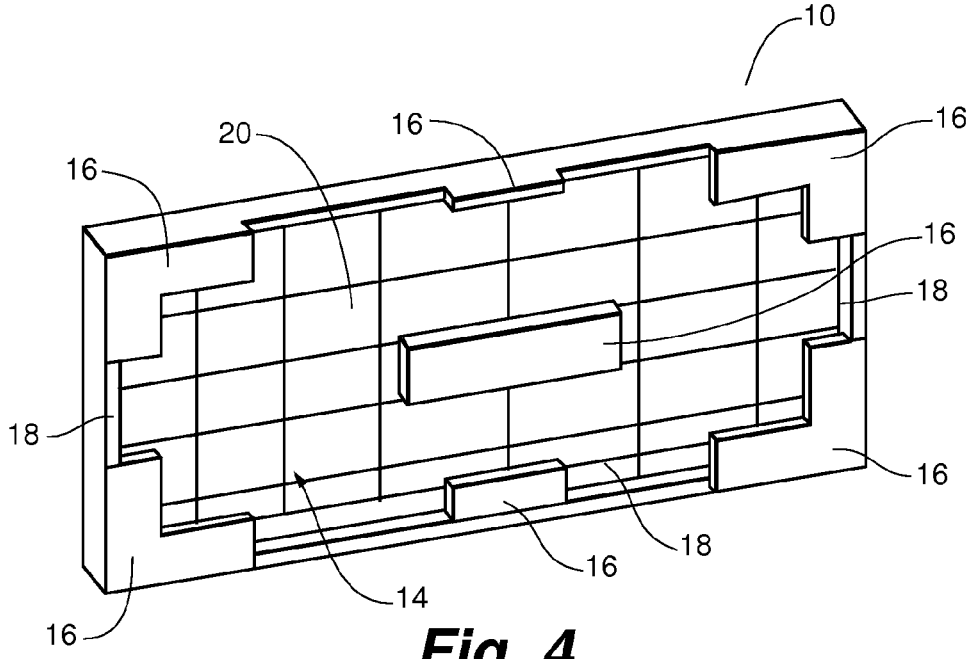
FIG. 4 is a front perspective view of one embodiment of a back surface of a polymeric veneering product of the present invention that includes a plurality of ribs.

FIGS. 2, 3 and 4 depict three embodiments of a back surface 14 of the veneering panels 10 of the present invention. In various embodiments of the present invention, the back surface 14 may be cored or hollowed, thereby reducing the amount of raw material, such as plastic resin, bulk molding compound and/or fiberglass utilized in the panel 10. The coring of the back surface 14 further provides channels 18 and reservoirs 20 for the free movement of air behind each panel. Such channels 18 and reservoirs 20 assist in preventing the presence and buildup of moisture behind the veneering product, which may deteriorate the building materials positioned behind each panel 10.

In some embodiments of the present invention the hollowed back surface may be filled with a sound deadening and/or insulating material. For example, an insulating foam (e.g. a polyurethane foam) may be sprayed or applied to the back surface of each panel to provide additional sound and/or thermal insulation.

In various embodiments of the present invention, the back surface 14 may be cored or hollowed in a similar replica image of the front surface 12 by including a back surface plate in the mold that has at least a partial replica image of the front surface 12 of the panel 10. In production, the melted resin would be injected between the front and back surface plates to form each panel 10. As previously mentioned, the hollowing of the back surface 14 reduces raw materials and in some embodiments provides a substantial uniform thickness for the panel, thereby maintaining the strength and durability of the panel 10. The uniform thickness also provides benefits in molding the panels 10 by evening the cooling of all portions of the panel 10 during molding. In other embodiments of the present invention the cored back surface 14 may further include one or more ribs 22, as depicted in FIG. 5, that extend from the top of the panel 10 to the bottom of the panel and/or from one side to the other side. Such ribs 22 allow for additional stability and structure to the panel and provides additional durability to address unwanted impacts with the panel 10.

The general plastic thickness of the panels of the present invention may vary depending upon the desired rigidity and also the manufacturing process (e.g. panels of structural foam will generally be thicker than panels that are high pressure injection molded). However, various embodiments of the panels of the present invention will have an average thickness of approximately 50 mils to 500 mils. In various embodiments the average thickness will be approximately 80 mils to 300 mils. In additional embodiments the average thickness of the panels will be approximately 120 mils to 250 mils. It is noted that portions of the panel, such as the attachment platforms or ribs, may be of a greater thickness, but a majority of the panel 10 will generally include the thinner wall thickness.

Furthermore, the front surface of each panel 10 may include various degrees of relief, thereby in some embodiments, providing the appearance of natural cut stone, rock or wood. The degrees of relief generally highlight the texture of the surface and are exhibited by the peaks and valleys present. The degrees of relief may vary depending upon the desired appearance. For example, various embodiments of the present invention may include large amounts of relief (e.g. up to 10 cm from high point to low point) providing a very rough texture. In other embodiments, the relief may be of average degree (e.g. up to 5 cm). And in yet other embodiments, the relief may be somewhat mild (e.g. up to 1.5 cm).

In various embodiment of the present invention, the front surface 12 of the panel 10 may be flat, rounded or beveled. The front surface 12 of this embodiment may include a beveled front having one or more bends, slants or creases in the front surface 12. In some embodiments the beveled front surface 12 takes on a tri-panel appearance, such as a beveling or slanting down at the edges. It is noted that the front surface 12 may also be rounded, substantially flat and/or include positions of relief to provide a more natural appearance.

As previously mentioned, embodiments of the front surface may be flat, rounded, include texture and relief and/or beveled to accommodate molding or fabrication (e.g. lamination, painting, photo or thermal activated coating) to provide the desired appearance. In various embodiments of the present invention the front surface is produced by imaging an actual natural surface, such as natural stone, rock, brick or wood. The imaging of the natural surface can be performed by processes such as cast imaging of the natural surface or by digital scanning the natural surface. When cast imaging the natural surface a mirror image of the surface can be produced by providing a casting material, such as silicone, ceramics or fine sand, and casting it over and/or around the natural surface. Once the casting material sets or has formed a mirror image of the natural surface the object casted is removed from the newly formed mold of the natural surface and an opposite image or negative of the natural surface has been produced. Next the negative image can be cast again with a solidifying material to produce the positive image of the natural surface. Such a process produces a casting that captures the texture and relief of the natural surface. Once the casted mirror images (i.e. positive and negative) are produced, a mold and/or a mold insert manufactured from a suitable mold material, such as aluminum, steel or a ceramic, can be produced for mass manufacture by administering the mold material to the positive and/or negative casting to form the production mold. In various embodiments of the present invention sand or ceramic is used to provide a detailed negative and/or positive image thereby providing the desired detail found in the natural surface which then can be transferred to a more durable steel or aluminum production mold for mass manufacture of panels having one or more natural surface images. Cast imaging of the natural surface may be performed by a cast foundry. Foundries that may be used to prepare such castings include but are not limited to Arrow Pattern and Foundry Company, 9725 South Industrial Drive, Bridgeview Ill. and WK Industries, 6120 Millett Ave., Sterling Heights, Mich.

Alternatively, a mold may be prepared by digitally scanning the natural surface, such that the surface of a stone, brick or piece of wood. Once scanned, a mold can be produced from a suitable mold material for mass manufacture of the front panels or fascias having a front surface supporting the scanned image. It is noted that the core side of the mold may be produced by either digitally scanning or casting the natural surface. Such imaging provides a core that will substantially mirror the front surface of the mold and thereby provide a manufactured panel 10 that is relatively uniform in thickness.

Figure 5A:
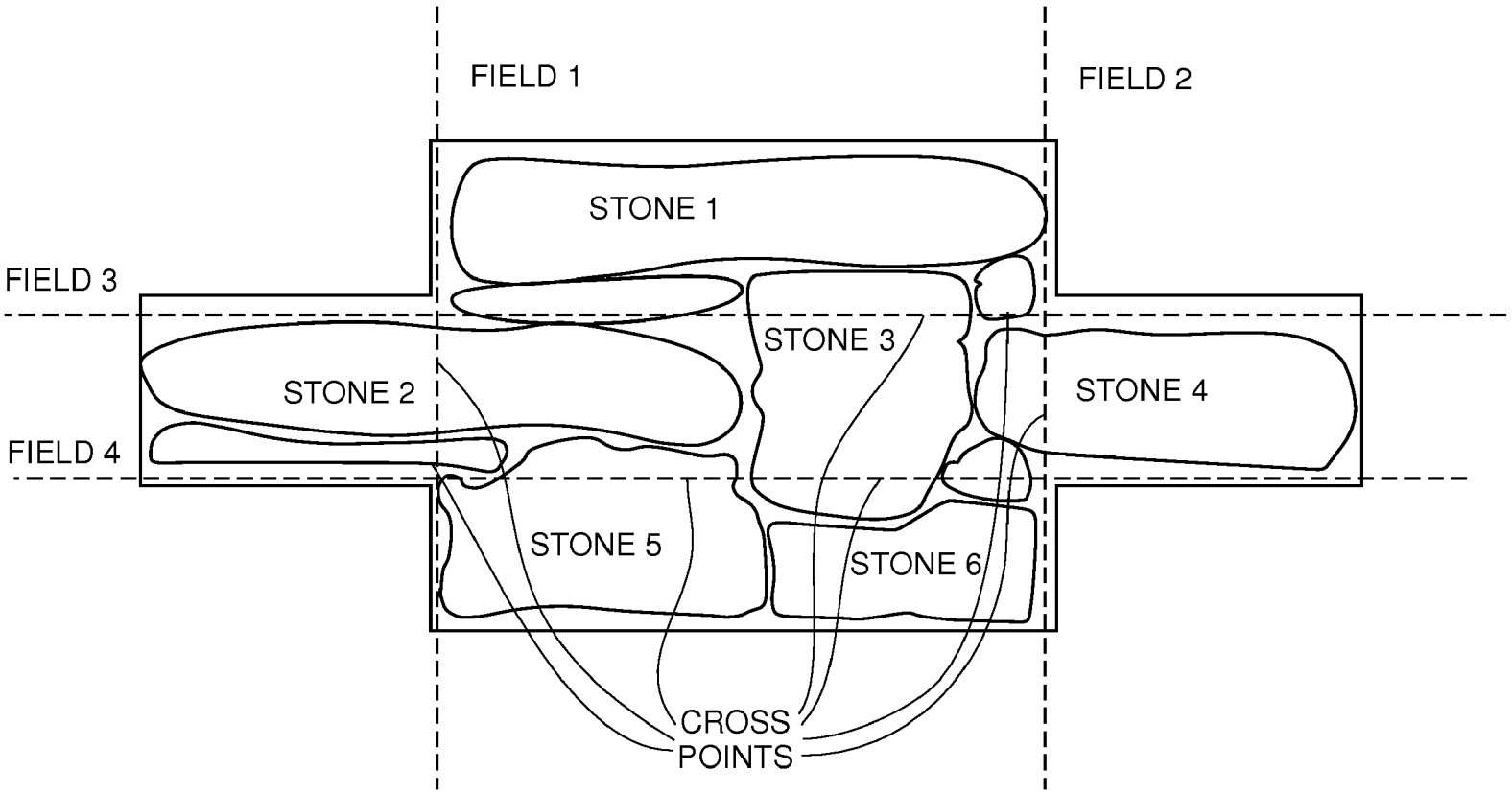
FIG. 5*a* is a front view of one embodiment of a front surface of a polymeric veneering product of the present invention that is in a T-unit configuration.
Figure 5B:
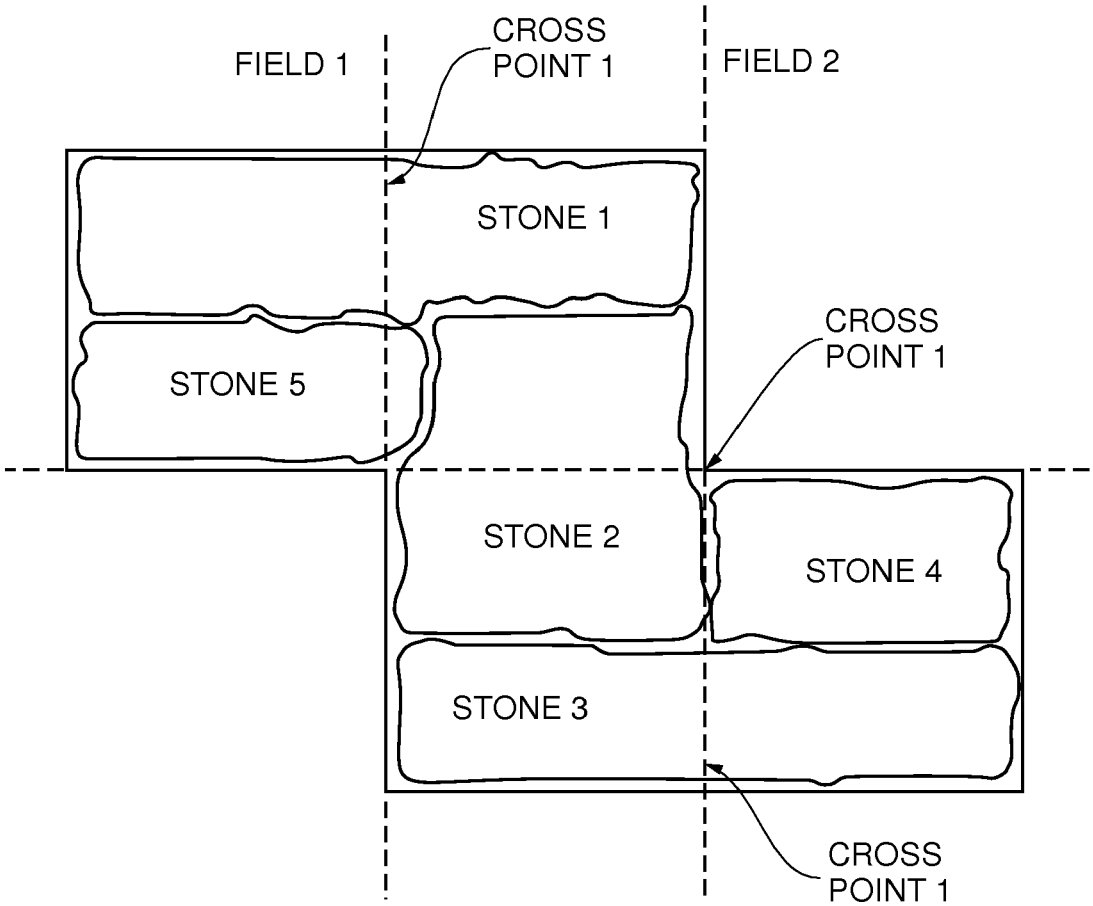
FIG. 5*b* is a front view of one embodiment of a front surface of a polymeric veneering product of the present invention that is in a Z-unit configuration.
Figure 5C:
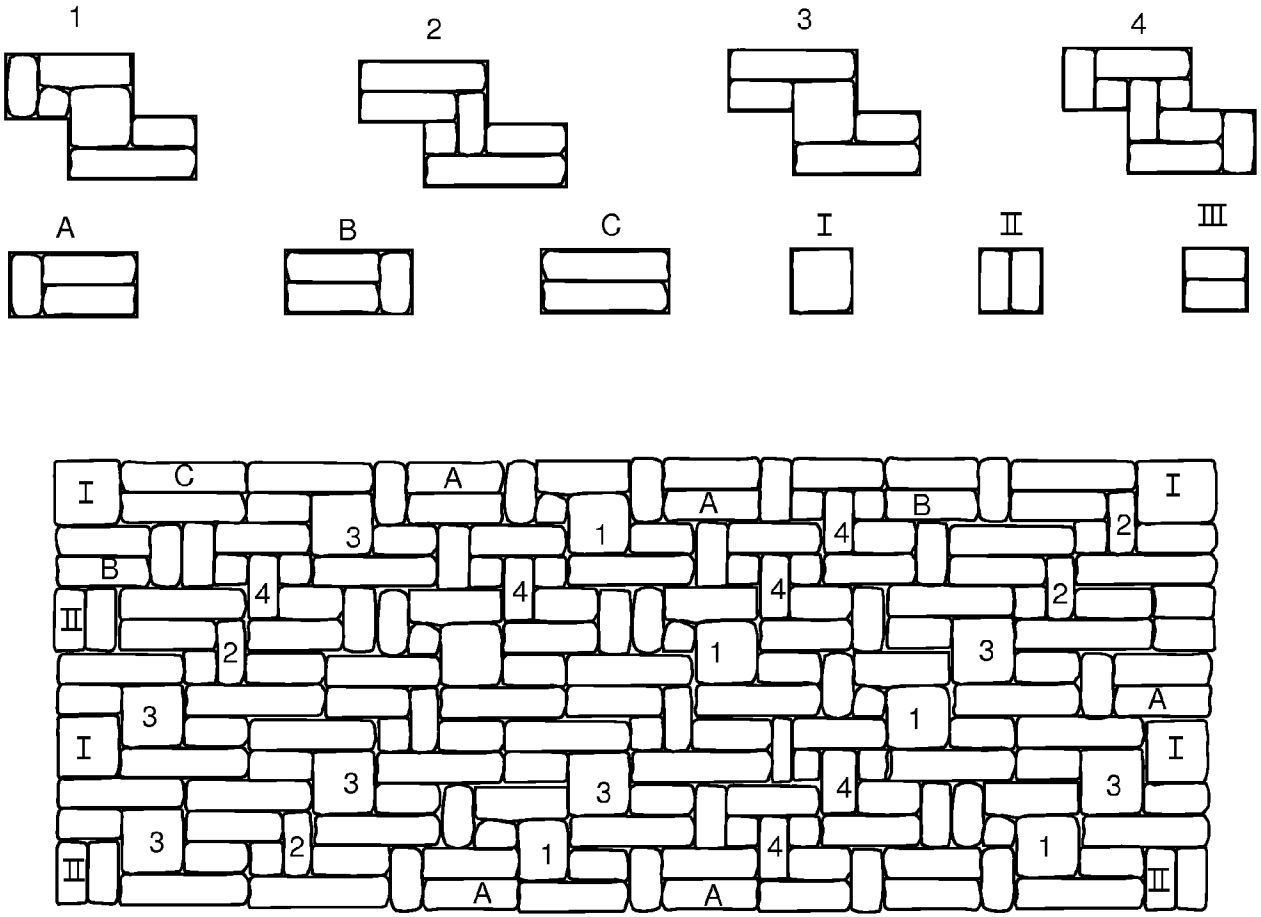
FIG. 5*c* is a front view of a wall including at least four Z-unit polymeric veneering product embodiments of the present invention.

As previously mentioned the panels of the present invention may take on the image of a single stone, brick or piece of wood. Alternatively, as depicted in FIGS. 5*a-c*, the veneering panel 10 may have the appearance of multiple stones. For example, a single panel may appear as a ledgestone configuration having a plurality of cut stones as depicted in FIG. 5*a*. In yet another embodiment, as depicted in FIGS. 5*b* and 5*c* the veneering panel 10 may appear to include a plurality of field stones or a plurality of cut stones in a random Ashlar pattern. Additionally, as previously suggested, the front surface 12 may include one or more colors, textures and/or degrees of relief to provide a natural stone, brick or wood appearance.

When covering a wall with panels that have the image of multiple items, such as stones, wood or brick, it is important to avoid the appearance of a reoccurring pattern. When utilizing such products it is not uncommon that visually unacceptable straight lines are formed when individual items, such as stones, are aligned, thereby forming long vertical or horizontal breaks in the wall wherein a series of stones or wood planks end in the same location. Such breaks are perceived as being an unacceptable pattern. Therefore, embodiments of the present invention are designed to provide imaged items, such as stones, brick or wood planks, in positions which break designated fields or planes. In such embodiments, individual stones are positioned on a majority of the panels (e.g. >50% of the panels or in other embodiment >75% of the panels) so as to break at least two or more fields/planes that extend partially along the perimeter of the panel, but also pass through the interior of the panel. In other embodiments of the present invention, individual stones are positioned on a majority of the panels (e.g. >50% of the panels or in other embodiment >75% of the panels) so as to break at least three or more fields/planes that extend partially along the perimeter of the panel, but also pass through the interior of the panel. In yet other embodiments of the present invention, individual stones are positioned on a majority of the panels (e.g. >50% of the panels or in other embodiment >75% of the panels) so as to break at least four or more fields/planes that extend partially along the perimeter of the panel, but also pass through the interior of the panel. If such fields are not broken by a strategically placed stone a reoccurring break pattern on the wall may become recognizable.

FIG. 5*a* depicts a T-unit panel 10 that includes four fields or planes that extend along the periphery of the panel 10, but also pass through the interior of the panel. In the T-Unit depicted in FIG. 5*a* at least one individual stone is found to break each of the four fields. The fields are designated by dashed lines and the field breaks are outlined with boxes. For example, stone 2 breaks field 1; stone 4 breaks field 2; stone 3 breaks field 3 and stones 3 and 5 break field 4.

FIG. 5*b* depicts another embodiment of the present invention wherein individual imaged items, such as stones, are positioned on a Z-unit panel 10. The Z-unit panel of this embodiment generally has 3 fields/units wherein one or more imaged items breaks each of the fields. For example, stone 1 breaks field 1; stone 2 breaks field 3 and stone 3 breaks field 2. The fields are designated with dashed lines and the breaks are designated in the boxes. Finally, FIG. 5*c* depicts a partial wall having at least 4 different Z-unit panels 1, 2, 3, 4 and a few finishing panels A, B, C, D and I, II, III. As can be seen in the wall, a wall constructed utilizing a majority of panels that break the fields avoid the unacceptable straight line breaks in the wall.

Figure 6A:
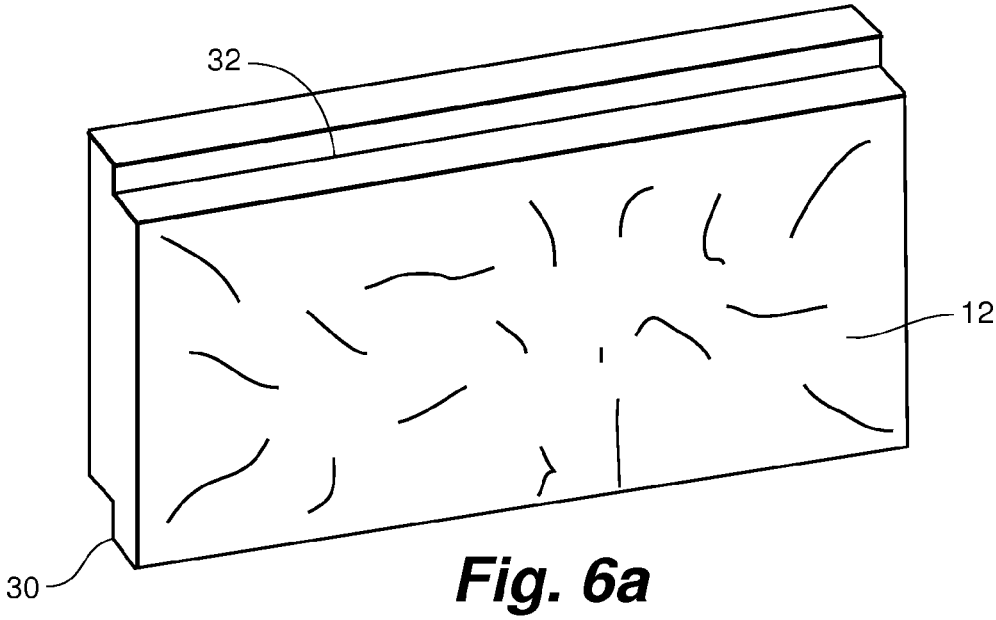
FIG. 6*a* is a front perspective view of one embodiment of a front surface of a polymeric veneering product of the present invention that includes intersecting members.

Various embodiments of the panels of the present invention may further include interlocking members that allow the panels to overlap and/or secure to each other. FIG. 6*a* depicts one embodiment of the present invention wherein the panel 10 includes a front overlap 30 and a back overlap 32. It is noted that such interlocking panels may also be found on the sides of the panels 10 rather than or in addition to being positioned on the top and bottom of the panels 10. Additionally, the front overlap 30 and back overlap 32 may have fastening devices to mechanically interconnect the panels to each other. Examples of fastening devices include, but are not limited to snaps, peg and slots, clips, adhesives, screws, rivets, nails and combinations thereof. In various embodiments screws, adhesives and combinations of these are utilized to secure the panels to the substrate. Further explanation of such panels are identified below.

Figure 6B:
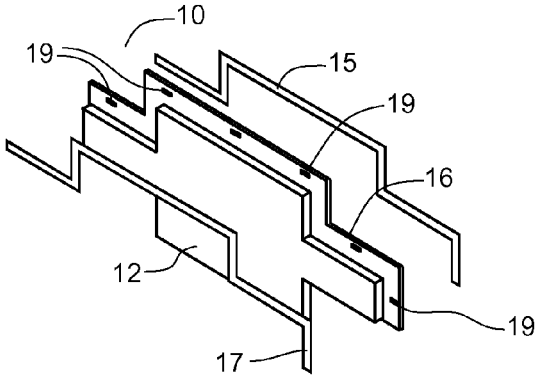
FIG. 6*b* is a front perspective view of one embodiment of a front surface of a polymeric veneering product of the present invention that is in a T-unit configuration and includes an adhesive fastening device.
Figure 6D:
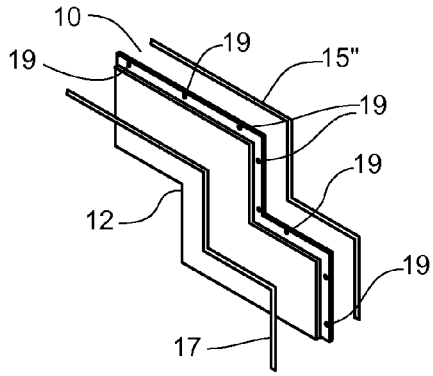
FIG. 6*d* is a front perspective view of one embodiment of a front surface of a polymeric veneering product of the present invention that is in a Z-unit configuration and includes an adhesive fastening device.
Figure 6C:
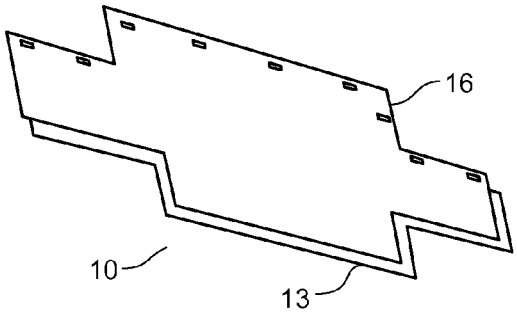
FIG. 6*c* is a back perspective view of one embodiment of a front surface of a polymeric veneering product of the present invention that is in a T-unit configuration.

FIGS. 6*b*-6*g* depict embodiments of the present invention that may be secured to a substrate, such as a wall with adhesives alone or with adhesives and screws, nails or rivets. As depicted in FIGS. 6*b* and 6*c* a T-unit panel 10 having a front surface 12 and an attachment platform 16 may be secured to a substrate, such as a wall, with one or more strips of adhesive 15 and secured to the panel above with a second strip or strips of tape/adhesive 17. Alternatively, rather than utilizing adhesive to secure each panel to the substrate, screws, nails, or rivets may be used to secure each panel 10 to the substrate by passing the screw, nail or rivet through one or more fastening apertures 19 positioned on the attachment platform 16. In various embodiments, screws, nails or rivets can simply be passed through the polymer attachment platform 16 without fastening apertures 19. It is noted that a depression 13 approximately the same width as or slightly greater in width than the attachment platform 16 may be positioned on the back bottom side of the panel 10 to nest the extra width of the tape 17 and/or attachment platform 16 of the adjacent panel, thereby allowing for a more flush system. A back perspective view that illustrates the depression 13 is depicted in FIG. 6*c*.

Figure 6E:
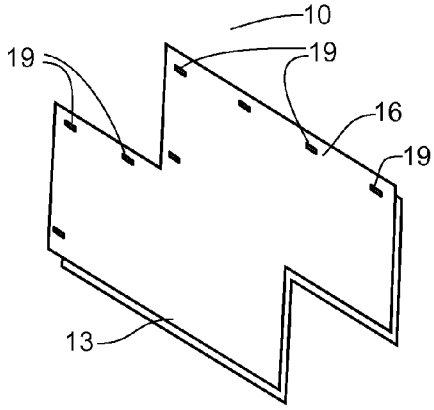
FIG. 6*e* is a back perspective view of one embodiment of a front surface of a polymeric veneering product of the present invention that is in a Z-unit configuration.

FIGS. 6*d* and 6*e* depict another embodiment of the present invention, wherein a Z-unit panel 10 having a front surface 12 and an attachment platform 16 may be secured to a substrate with one or more strips of adhesive/tape 17 and secured to the panel above with a second strip or strips of adhesive 17. Alternatively, similar to the T-unit described above, screws, nails, or rivets may be utilized to secure each panel 10 to a substrate by passing the screw nail or rivet through one or more fastening apertures 19 positioned on the attachment platform 16. In various embodiments, screws, nails or rivets can simply be passed through the polymer attachment platform 16 without fastening apertures 19. Similar to the T-unit embodiment, a depression 13 approximately the same width as or slightly greater in width than the attachment platform 16 may be positioned on the back bottom side of the panel 10 to nest the extra width of the tape and fastening ridge of adjacent units thereby allowing for a more flush system. A back perspective view that illustrates the depression 13 on a Z-unit panel is depicted in FIG. 6*e*.

Figure 7A:
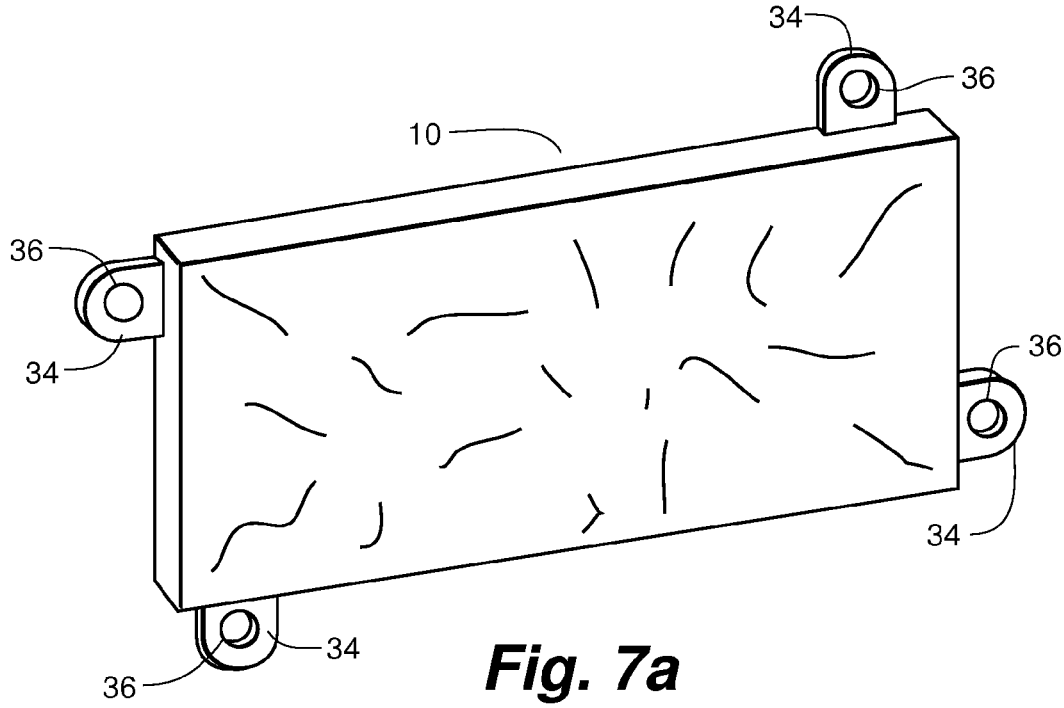
FIG. 7*a* is a front perspective view of one embodiment of a front surface of a polymeric veneering product of the present invention that includes a plurality of attachment spacers adjoined to the panel.
Figure 7:
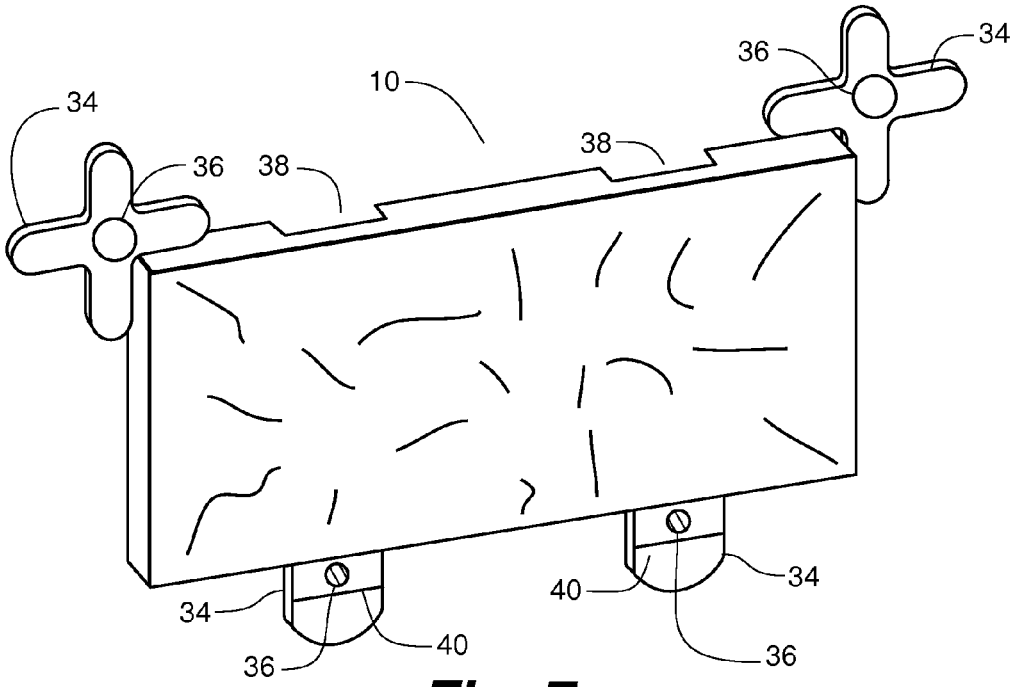
FIG. 7 is a front perspective view of one embodiment of a front surface of a polymeric veneering product of the present invention that includes a plurality of attachment spacers adjoined to the panel.

Other embodiments of the present invention may be secured to a wall or substrate utilizing one or more mechanical fasteners, such as screws, nails, rivets and/or clips. FIGS. 7 and 7*a* depict other embodiments of the present invention wherein securing spacers 34 are adjoined to the sides of the panels 10 to provide another means for attachment of the panel 10 to a wall or substrate and further to provide the desired spacing when a mortared wall appearance is desired. The spacer 34 may include one or more securing apertures 36 for passing a screw through the spacer 34, thereby securing the panel to the wall or support. The spacers 34 may also function to provide adequate spacing between panels to accommodate the application of a grout caulk between the panels to provide the appearance of a mortared wall. Any tile or grout caulk may be utilized with the present invention. For example an acrylic or silicone grout caulk (e.g. a sanded tile and grout caulk), such as one manufactured by ColorFast Industries, Inc., 350 West H Street, Colton, Calif. 92324 may be utilized with the present invention.

Additionally, one or more of the spacers 34, as depicted in FIG. 7 may further include a spacer ridge 40 for setting the distance between panels by acting as a stop when inserting such spacers 34 into spacer apertures 38. The spacer apertures may be generally positioned on an adjacent panel 10 to accept and interlock the panels being adjoined.

Figure 7B:
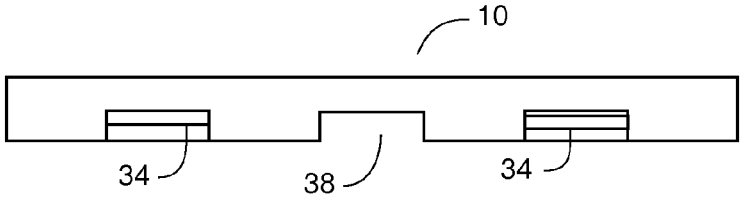
FIG. 7*b* is a side view of one embodiment of a front surface of a polymeric veneering product of the present invention that includes a plurality of attachment spacers adjoined to the panel.

FIG. 7*b* depicts a bottom view of the panel embodiment of FIG. 7, wherein the panel 10 further includes a spacer aperture 38 for accommodating the insertion of one of the spacers 34 positioned on the top side of such a panel 10. Such apertures 38 are generally utilized when adjacent rows of panels 10 are staggered thereby requiring the nesting of the top portion of a t-shaped spacer in a panel positioned above. The spacer apertures may be include in any embodiment of the present invention to provide the potential to establish a mortarless appearance. It is noted that all such embodiments may further include securing platforms, similar to those depicted in FIGS. 2, 4 and 5 for either securing the panels 10 with an adhesive, such as glue or two sided tape, or securing the panels 10 with both adhesives and screws, rivets or nails.

Figure 7C:
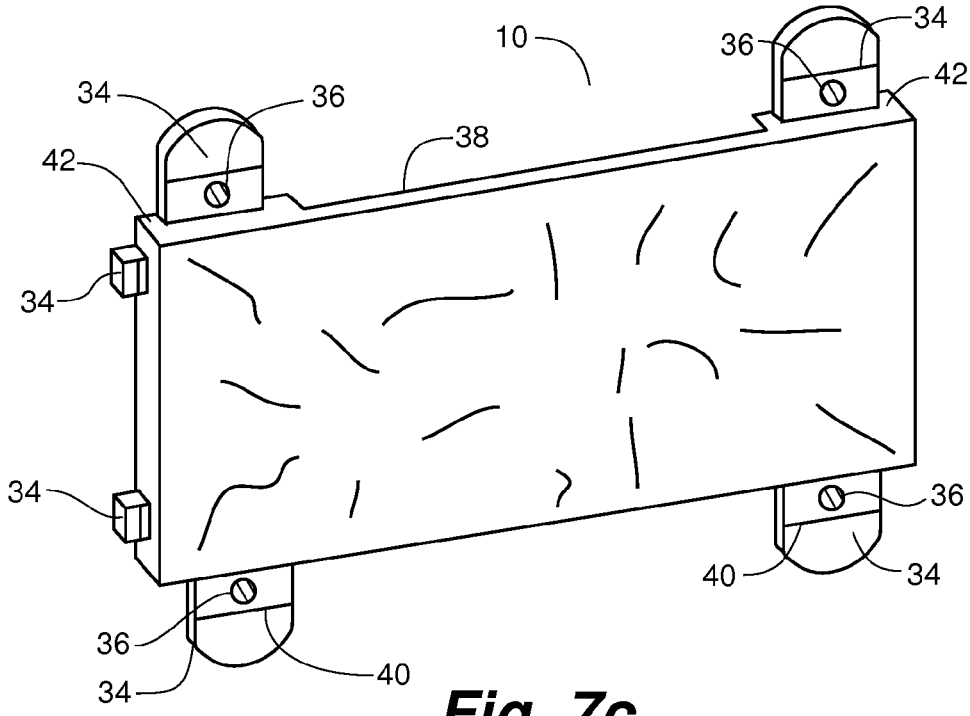
FIG. 7*c* is a front perspective view of one embodiment of a front surface of a polymeric veneering product of the present invention that includes a plurality of attachment spacers adjoined to the panel.
Figure 7D:
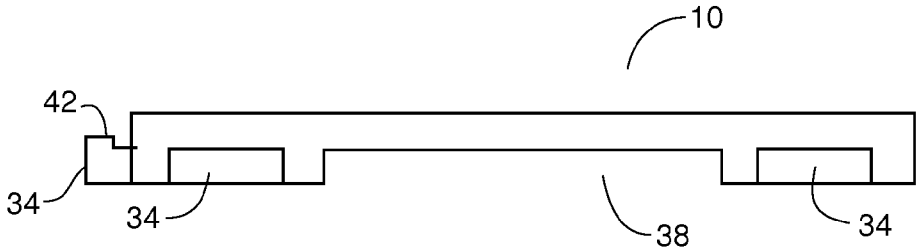
FIG. 7*d* is a side view of one embodiment of a front surface of a polymeric veneering product of the present invention that includes a plurality of attachment spacers adjoined to the panel.

FIGS. 7*c* and 7*d* depict yet another embodiment of a panel of the present invention, wherein the panel 10 further includes spacers 34 that may be utilized to provide spacing for grout application or that may be inserted substantially within apertures 38 of adjacent panels 10 to provide a stone on stone appearance (no grout). In such embodiments, each panel 10 includes spacers 34 and spacer apertures 38 that can accommodate the spacing and interlocking of adjacent panels 10. In various embodiments, the spacers may include a spacer ridge 40 that may butt up against an adjacent panel to provide for proper spacing when grouting is desired. Alternatively, the spacer 34 may be pushed pass the ridge 40 and further into the aperture to accommodate a stone on stone appearance. Additionally, the spacers may include securing apertures 36 for passing a screw, rivet, nail or other securing means into the wall or substrate behind each panel. Each spacer 34 may further include a score line 42 for breaking off the spacers 34 if they are not utilized.

Figure 8A:
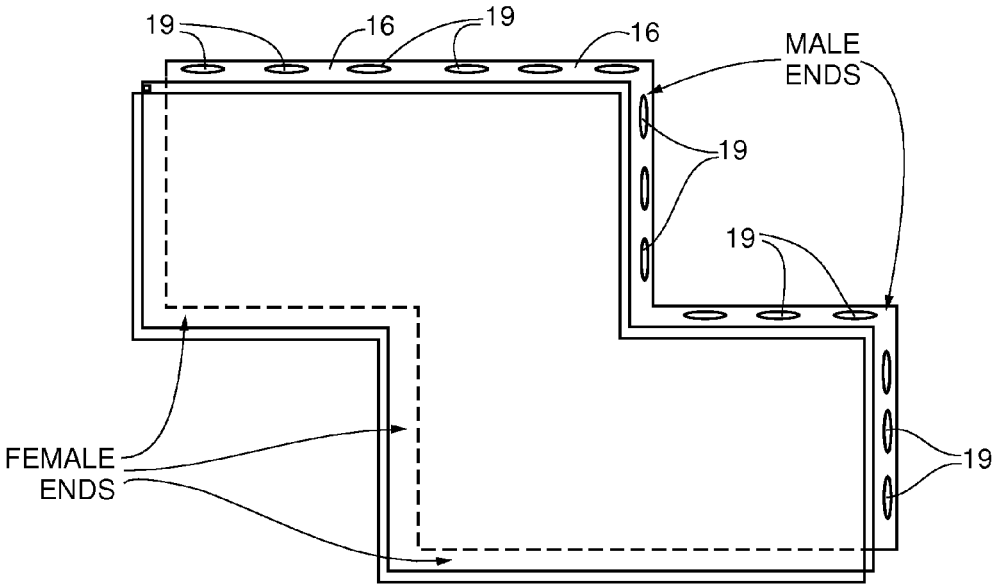
FIG. 8*a* is a front view of one embodiment of a polymeric veneering product of the present invention having a Z-unit configuration and including a tongue and groove fastening system.
Figure 8B:
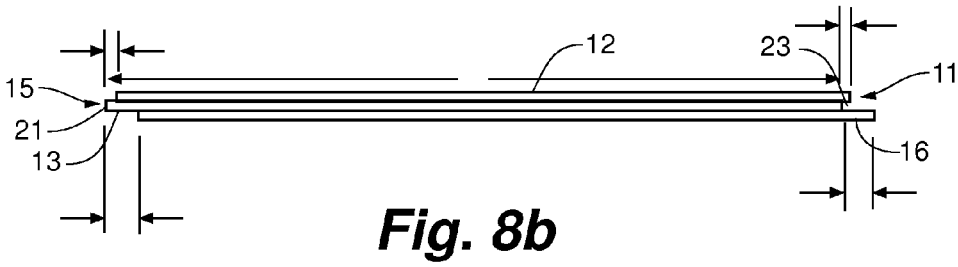
FIG. 8*b* is a side view of one embodiment of a polymeric veneering product of the present invention having a Z-unit configuration and including a tongue and groove fastening system.

FIG. 8*a* depicts another embodiment of the invention that includes a tongue and groove panel attachment. The Z-unit panel 10 of FIG. 8*a* includes attachment platform 16 on the male end 11 and a depression 13 for accepting the attachment platform 16 positioned on the female end 15 of the panel 10. The attachment platform 16 may include one or more apertures 19 that are configured to accept screws, nails or rivets for securing the panel 10 to a substrate, such as a wall. FIG. 8*b* depicts a side view of the panel of FIG. 8*a* wherein the panel 10 includes a tongue 21 positioned on the female end 15 and a groove 23 positioned on the male end 11. It is noted that the tongue 21 may comprise multiple tabs rather than a single elongated tongue that extends along the majority of one or more sides of the panel 10. Furthermore, the groove 23 may be a series of apertures positioned along one or more sides of the panel 10 rather than a groove 23 that extends across the entire length of the one or more sides. However, it is generally recommended that the groove 23 extend along the entire length of the one or more sides to provide more forgiveness in assembly.

During assembly of a wall using the embodiment depicted in FIGS. 8*a-b*, a first panel 10 is positioned over a second panel that has been secured onto a wall. Next, the tongue 21 of the first panel is inserted into the groove of the second panel and the first panel is pushed down into the groove until the panel is in the proper positions. Next the first panel is secured to the wall by adhering the attachment platform 16 to the substrate, such as a wall, with adhesive/tape or by screwing, nailing or riveting the attachment platform 16 to the substrate with screws, nails or rivets.

Figure 9D:
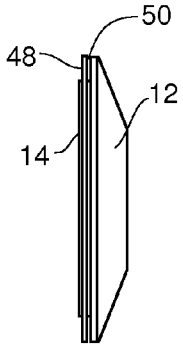
FIG. 9*d* is a side view of one embodiment of a panel of a polymeric veneering system of the present invention that is adjoined to a wall or substrate with a barb clip.
Figure 9A:
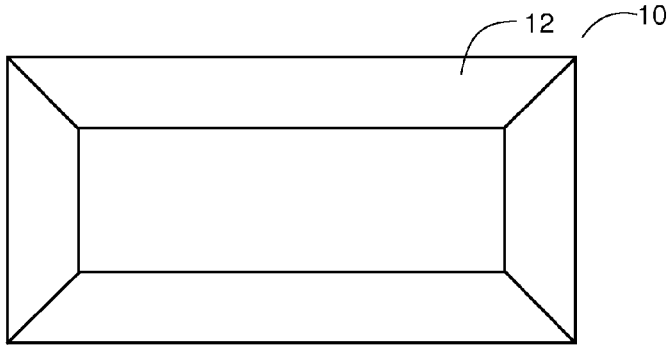
FIG. 9*a* is a front view of one embodiment of a panel of a polymeric veneering system of the present invention that is adjoined to a wall or substrate with a barb clip.
Figure 9B:
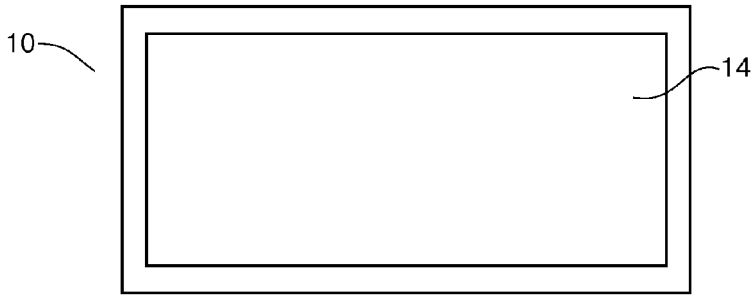
FIG. 9*b* is a back view of one embodiment of a panel of a polymeric veneering system of the present invention that is adjoined to a wall or substrate with a barb clip.
Figure 9C:
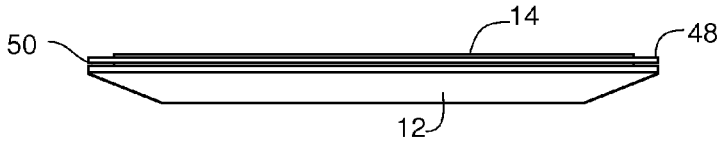
FIG. 9*c* is a top view of one embodiment of a panel of a polymeric veneering system of the present invention that is adjoined to a wall or substrate with a barb clip.

Other embodiments may utilize securing clips to attach panels of the present invention to a wall or substrate. FIGS. 9-14*c* depict embodiments of the present invention, wherein the panels 10 are secured to a wall or substrate with a securing clip. In various embodiments of the present invention, the securing clip is a barb clip 44. FIGS. 9*a-d* depict various views of one embodiment of a panel 10 of the present invention that utilize a barb clip for securing the panels to a substrate, such as a wall. FIGS. 9*a* and 9*b* depicts front and back views of one embodiment of the present invention wherein the panel 10 includes a front surface 12 with beveled edges and a back surface 14. A ridge 48 extends along the periphery of two or more sides of the panel 10 thereby creating a slot 50 positioned between the front surface 12 and the ridge 48. See FIGS. 9*c* and 9*d*. The ridge 48 and slot 50 provide a means for inserting the ridge 48 between the barbs of one or more barb clips 44, thereby securing the panel to the wall or substrate and the adjacent panels 10. It is noted that in other embodiments, the ridge 48 may include one or more barbs that can be utilized to further secure the panel to the barb clip 44.

Figure 10C:
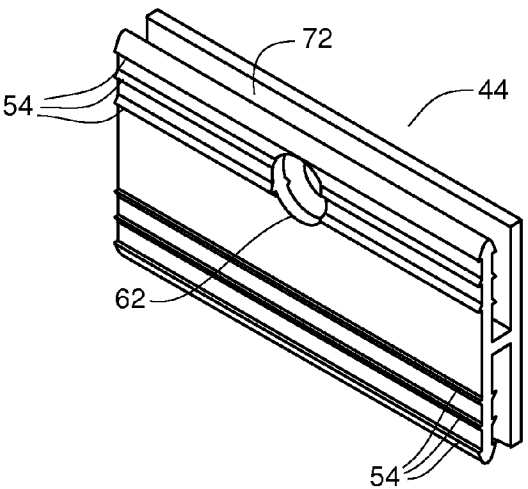
FIG. 10*c* is a front perspective view of one embodiment of a barb clip of the present invention.
Figure 10B:
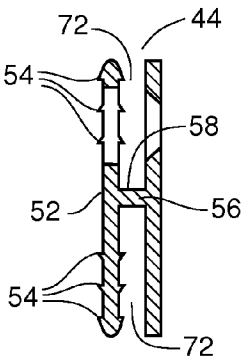
FIG. 10*b* is a side view of one embodiment of a barb clip of the present invention.
Figure 10A:
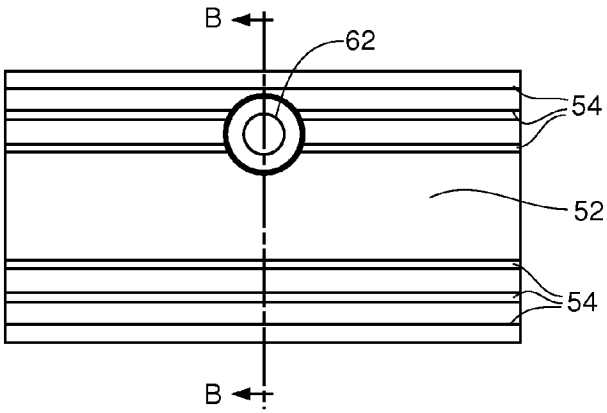
FIG. 10*a* is a front view of one embodiment of a barb clip of the present invention.

FIGS. 10*a*-10*c* depict one embodiment of a barb clip 44 that may be utilized in securing the panels 10 of the present invention to a wall or substrate and to adjacent panels. The barb clip 44 of this embodiment generally includes a front plate 52 including one or more barbs 54 operably adjoined to a backing plate 56 by a clip spacer 58. In such embodiments, the clip spacer 58 adjoins the front plate 52 and back plate 56 to form a channel 72 for accepting the ridge 48 of the panel 10. The front plate 52 and back plate may further include an aperture or depression 62 positioned to accept a securing fastener 60, such as screws, rivets, nails and the like. However, other securing means may be utilized such as adhesives (e.g. glues or two sided tapes). The barb clip may be made of any suitable material such as plastics, ceramics, metals, alloys and the like. For example, the barb clip 44 may be manufactured with a metal or alloy, such as aluminum or stainless steel, a plastic, such as a polyester or a polycarbonate, or bulk molding compound (thermoset).

Additionally, in various embodiments the spacing of the barbs 54 on the front plate 52 may be utilized to set the spacing of the panels 10 during installation. For example, by inserting the ridge 48 past the first or second barbs 54, a panel 10 may be spaced from existing panels at the proper distance to accept grout caulk between. Each barb 54 acts to restrict the further movement of the panel in a direction closer to the adjacent panels. Alternatively, by inserting the ridge 48 past the last barb 54 on the barb clip 44, a panel 10 may be positioned contiguously against the side of the adjacent panels 10.

Figure 11B:
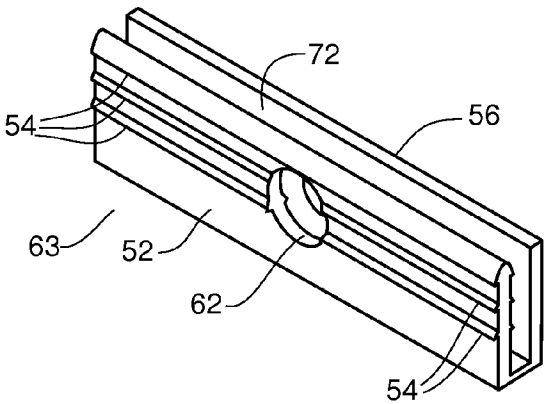
FIG. 11*b* is a front perspective view of one embodiment of a starter clip of the present invention.
Figure 11C:
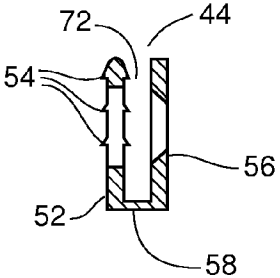
FIG. 11*c* is a side view of one embodiment of a starter clip of the present invention.
Figure 11A:
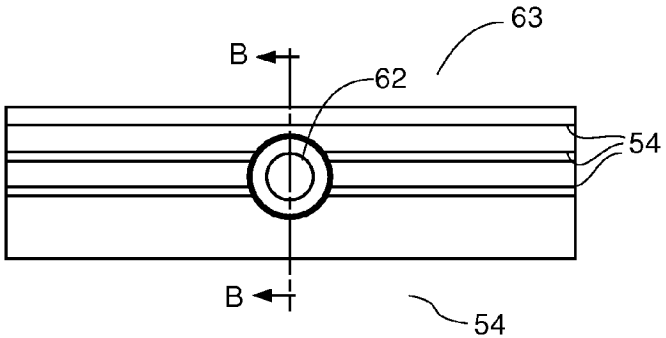
FIG. 11*a* is a front view of one embodiment of a starter clip of the present invention.

FIGS. 11*a*-11*c* depict a starter clip 63, which operates in a similar way to the barb clip 44 previously described, but may be utilized at wall or substrate edges. The starter clip 63 generally includes a front plate 52 that includes one or more barbs 54 operably adjoined to a backing plate 56 with a clip spacer 58. Similar to the barb clip 44, in various embodiments, the starter clip 63 may be secured to a wall or substrate by passing a fastener, such as a screw, nail or rivet, through an aperture or depression 62. Alternatively, the starter clip 63 may be secured to the substrate with an adhesive, such as a sealant or two sided tape.

Figure 12:
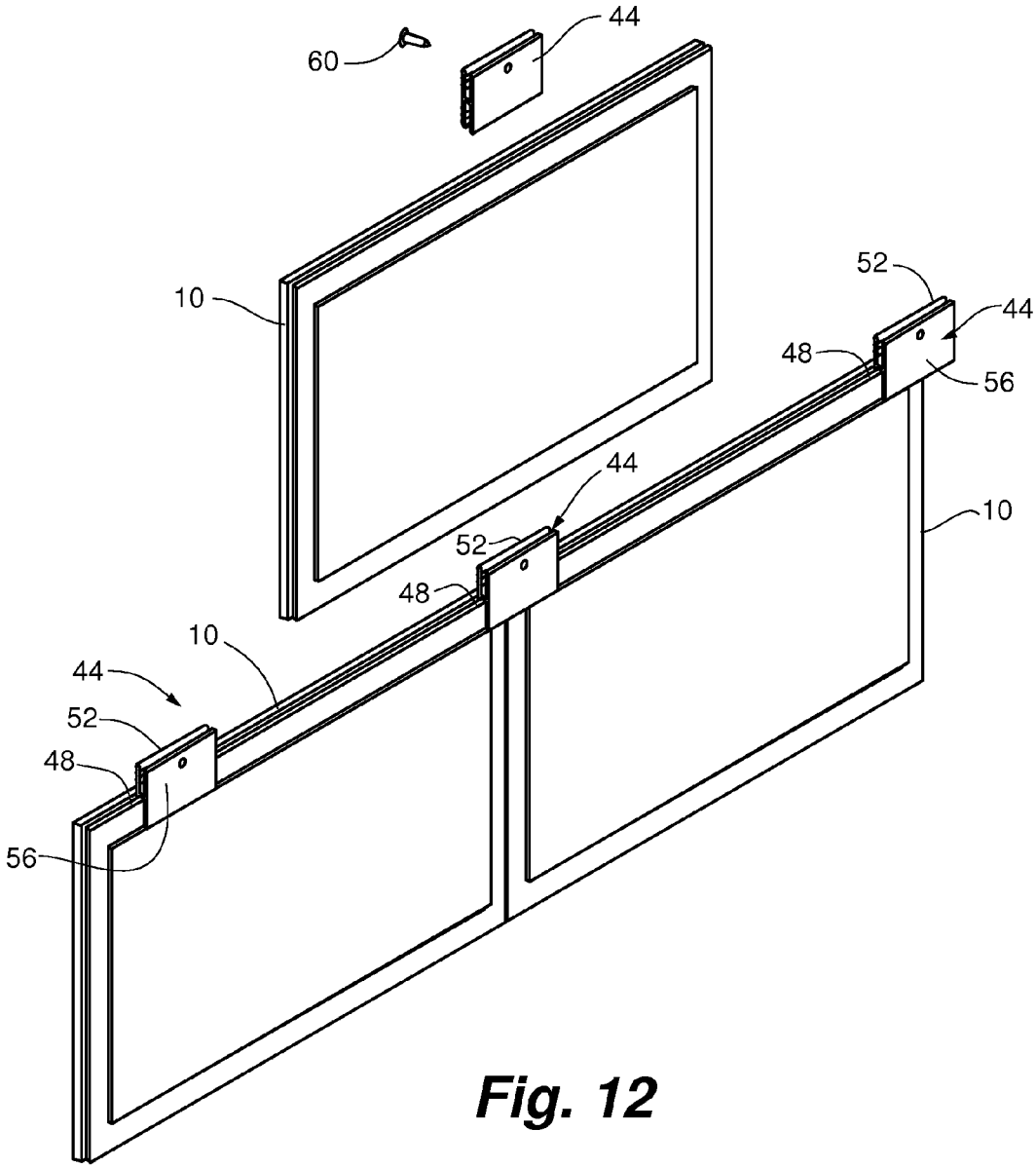
FIG. 12 is a perspective view of one embodiment of a polymeric veneering product of the present invention that is adjoined to two other panels of the present invention with a barb clip.
Figure 13D:
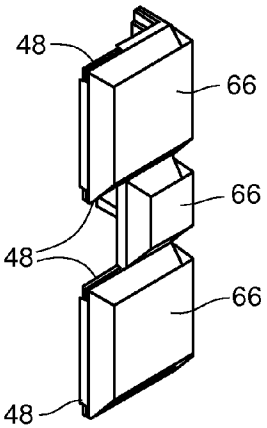
FIGS. 13*a-e* are various views of one embodiment of a corner wall cover of a polymeric veneering product of the present invention.
Figure 13C:
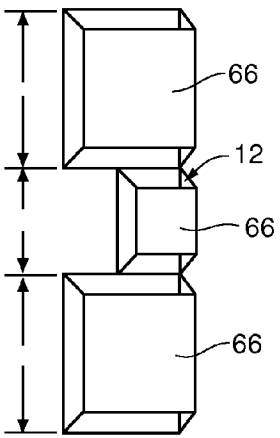
Figure 13B:
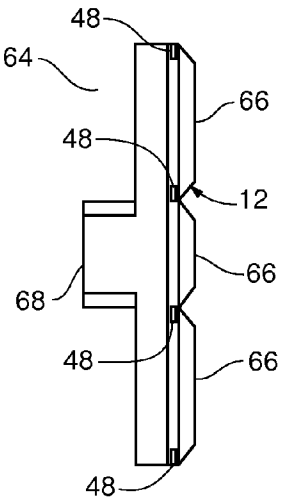
Figure 13A:
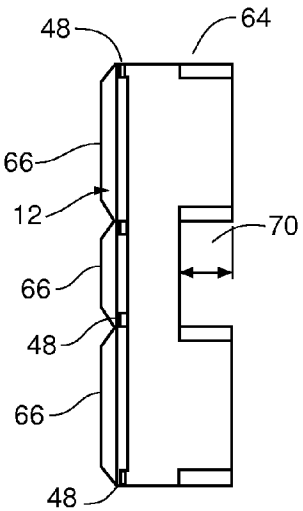
Figure 13E:
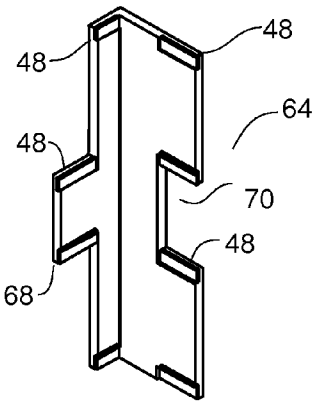

In operation, as depicted in the back view of FIG. 12, a panel 10 of this embodiment is secured to a substrate, such as a wall, by inserting the ridge 48 of the bottom of a panel 10 into the channel 72 of one or more starter clip(s) 63 that have been already secured to the substrate. Next, the ridge 48 on the top of the panel 10 is inserted into the channel(s) 72 between the front plate 52 and backing plate 54 of one or more barb clip(s) 44. Once the barb clips 44 are secured to the panel(s) 10, the clips 44 are secured to the wall or substrate with one or more fasteners 60, such as screws or adhesives. This process is repeated until the bottom row of the wall is secured to the substrate, such as a wall. Once the bottom row is secured, a panel 10 of this embodiment is secured to a wall or substrate by inserting the ridge 48 of on the top of a panel 10 into the channel 72 of a barb clip 44 and next inserting the ridge 48 on the bottom of the panel 10 into the channel 72 between the front plate 52 and backing plate 54 of the barb clip(s) secured to the panel(s) positioned below. Next a fastener 60 is placed in the aperture of the first barb clip 44 positioned on the top of the panel 10 and the barb clip 44 is fastened to the wall or substrate, thereby securing the panel 10 to the wall or substrate. This process is continued until the wall is covered with panels 10. It is noted that this process may be altered by securing the panels 10 from the top of the wall or substrate downward or securing the panels on one side of a wall or substrate and moving to the other side of the wall or substrate.

FIGS. 13*a*-13*e* depict one embodiment of a corner panel 64 that may be utilized with the panels 10 and barb clips 44 described above. In this embodiment, the corner panel 64 generally includes a plurality of stones 66 molded into the front surface 12. However, in other embodiments, the corner panel 64 may also be molded to feature only a single stone. In some embodiments that include a plurality of stones in a single panel, the panel may include a stone projection 68 that may be positioned between two panels 10 and/or a recess 70 that may receive a regular panel 10. It is noted that the corner panel projection 68 may be inserted into a corner panel recess 70 to complete the covering of a wrap around corner. Similar to the panels described above, the corner panels 64 may include ridges 48 that extend along one or more sides of the corner panel 64 that may be inserted into barb clips 44 or starter clips 63 to adjoin the corner panels 64 to adjacent panels 10 and secure the corner panels 64 to the substrate.

Figure 14B:
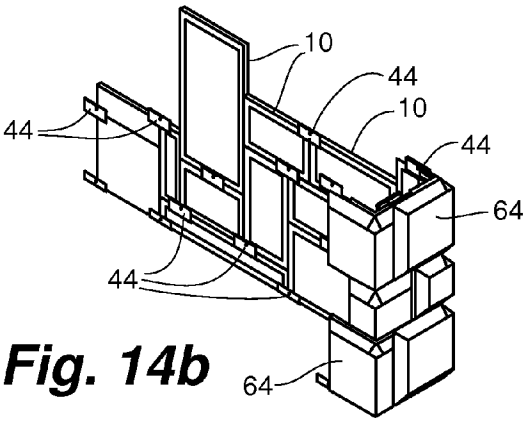
FIGS. 14*a-c* are various views of a wall covering system that includes a plurality of panels and corner panels secured by barb clips.
Figure 14C:
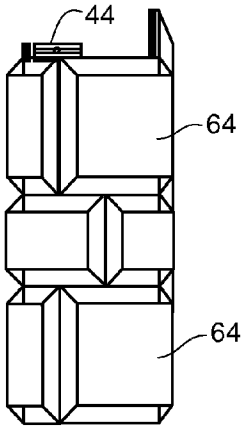
Figure 14A:
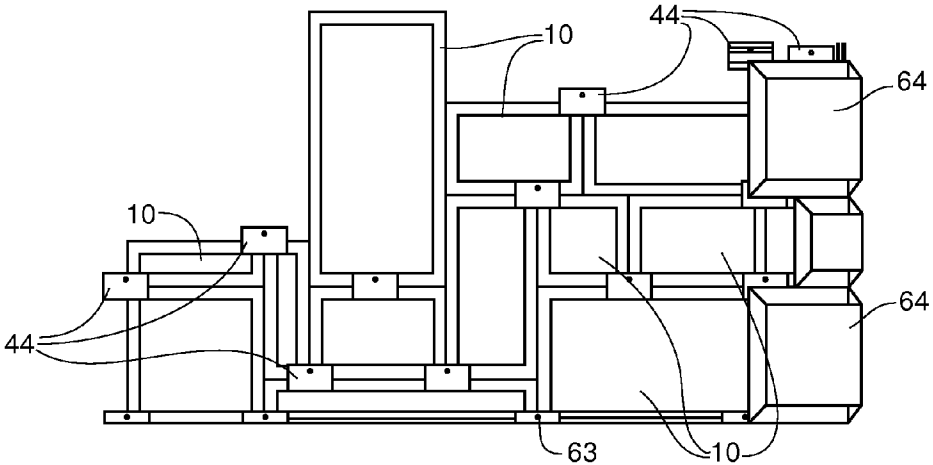
Figure 15A:
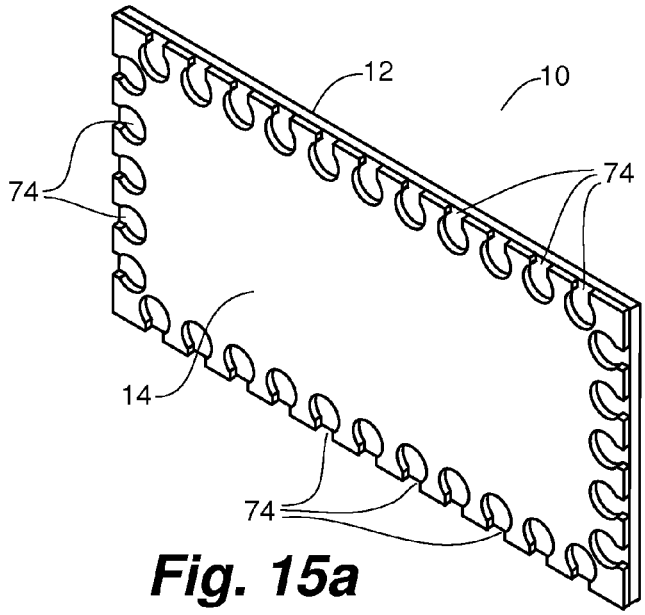
FIG. 15*a* is a back perspective view of one embodiment of a panel of a polymeric veneering system of the present invention that is adjoined to a wall or substrate with a radius clip.
Figure 15A:
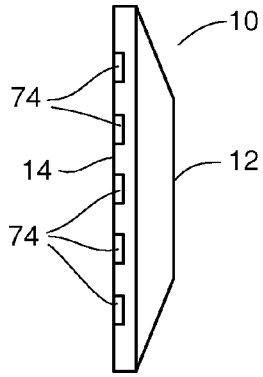
Figure 15C:
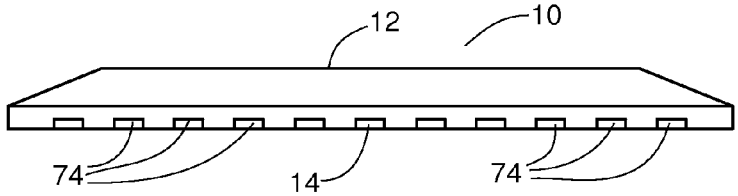
FIG. 15*c* is a top view of one embodiment of a panel of a polymeric veneering system of the present invention that is adjoined to a wall or substrate with a radius clip.

FIGS. 14*a*-14*c* depict the corner panel 64 incorporated into a wall assembly with a wrap around corner that includes a plurality of panels 10 adjoined by barb clips 44. As previously suggested, each corner panel 64 and/or each panel 10 of the present invention may take on the appearance of a single stone, rock, timber and the like or may take on the appearance of a plurality of stones, rocks, timbers and the like.

FIGS. 15-24*e* depict embodiments of the present invention, wherein the panels 10 are secured to a wall or substrate with a securing clip in the form of a radius clip. FIGS. 15*a*-*c* depict various views of one embodiment of a panel 10 of the present invention that utilize a radius clip for securing the panels 10 to a substrate, such as a wall. FIG. 15*a*-15*c* depicts back perspective, side and top views of one embodiment of the present invention wherein the panel 10 includes a front surface 12 with beveled edges and a back surface 14. In various embodiments of the present invention, a plurality of sockets 74 extend across the periphery of two or more of the top, bottom and/or sides of the panel 10 thereby creating a plurality of attachment points to adjoin each panel 10 with the wall or substrate. The sockets 74 may be of any shape or size, but all provide a means for securing the panel 10 to the wall or substrate and also to the adjacent panels 10. In various embodiments of the present invention the sockets are circular or elliptical in shape and have a radius of approximately 1 inches to 2.5 inches. In various embodiments the radius of the sockets 74 approximately 15 inches to 1.5 inches and in other embodiments the radius of the sockets are 0.3 inches to 1 inch. It is noted that any socket shape may be utilized. For example, shapes such as polygonal, rectangular, square may be utilized as socket shapes.

Figure 16A:
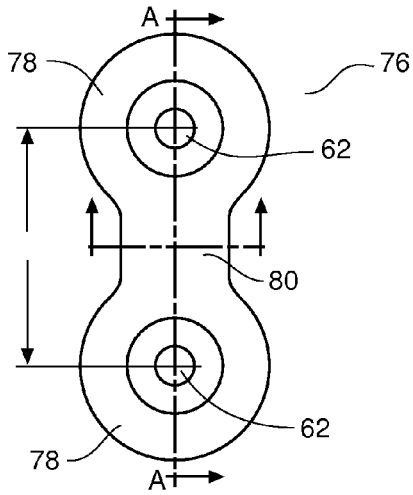
FIG. 16*a* is a front view of one embodiment of a radius clip of the present invention.
Figure 16B:
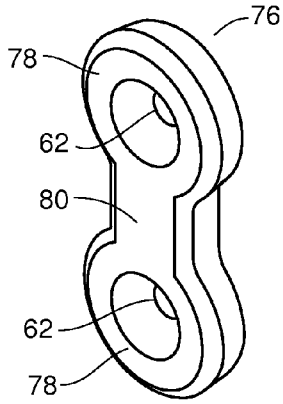
FIG. 16*b* is a front perspective view of one embodiment of a radius clip of the present invention.
Figure 16C:
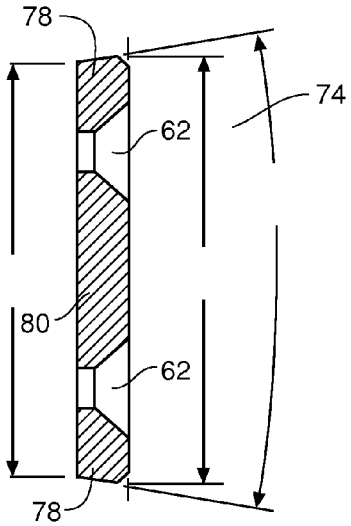
FIG. 16*c* is a side cross-section view of one embodiment of a radius clip of the present invention.

FIGS. 16*a*-16*c* depict one embodiment of a radius clip 76 that may be utilized in securing the panels 10 of the present invention to a wall or substrate and to adjacent panels. The radius clip 76 of this embodiment generally includes two or more attachment members 78 adjoined by a clip neck 80. Each attachment member 78 is generally shaped and sized to be accepted by the sockets 72 positioned on the edges of the panels 10. Furthermore, the attachment members 78 may further include an aperture or depression 62 positioned to accept a securing fastener 60, such as screws, rivets, nails and the like. However, other securing means may be utilized such as adhesives (e.g. glues/sealants or two sided tapes). The radius clip 76 may be made of any suitable material such as plastics, ceramics, metals, alloys and the like. For example, the radius clip 76 may be manufactured with a metal or alloy, such as aluminum or stainless steel, a plastic, such as a polyester, polyethylene, polypropylene or a polycarbonate, or a fiberglass or bulk molding compound (thermoset).

Figure 17A:
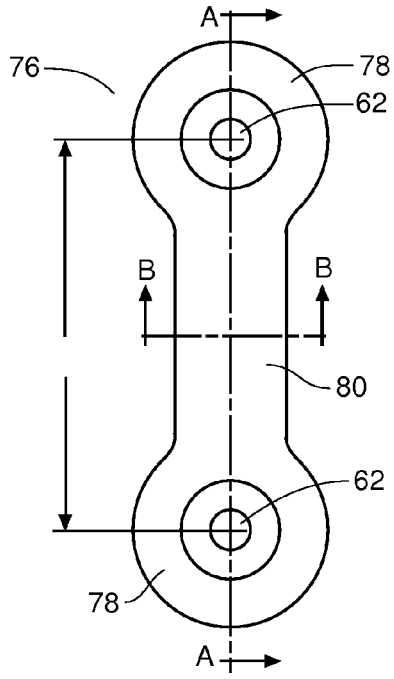
FIG. 17*a* is a front view of one embodiment of a radius clip of the present invention that may be utilized with grout caulk.
Figure 17B:
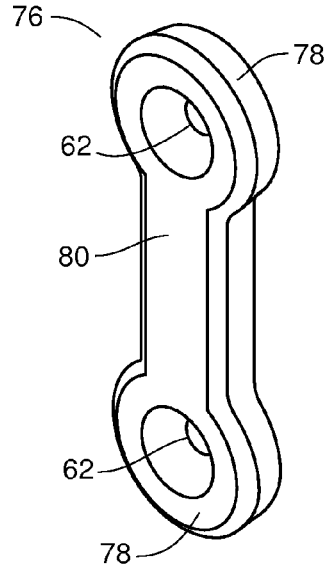
FIG. 17*b* is a front perspective view of one embodiment of a radius clip of the present invention that may be utilized with grout caulk.
Figure 17C:
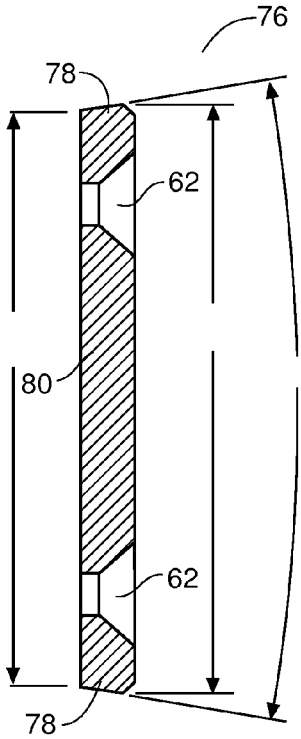
FIG. 17*c* is a side cross section view of one embodiment of a radius clip of the present invention that may be utilized with grout caulk.

In various embodiments, the radius clip 76 may be of a length that positions panels 10 in a proximate position to adjacent and/or surrounding panels 10, thereby providing little to no gaps between panels. However, in other embodiments, the radius clip 76 may be of a longer length to provide gaps between adjacent panels. When utilizing the longer radius clips 76, the gaps may be filled with a grout caulk to provide a mortared wall appearance. FIGS. 17*a*-17*c* depict one embodiment of a radius clip 76 that may be utilized to provide the desired gaps between adjacent panels 10. In this embodiment, the clip neck 80 is extended to provide additional length to the radius clip 76 thereby providing the desired gaps when the panels 10 are assembled on the wall or substrate. Additionally, in various embodiments, as depicted in FIGS. 16*a* and 17*a*, the clip neck 80 has a width that is less than the width of the attachment members 78.

Figure 18A:
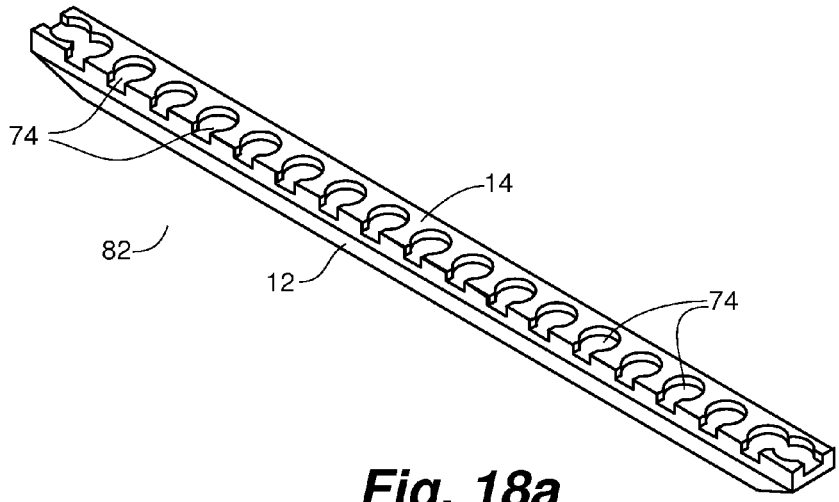
FIG. 18*a* is a front perspective view of one embodiment of a edge wall cover that may be utilized in the polymeric veneering system of the present invention.
Figure 18B:
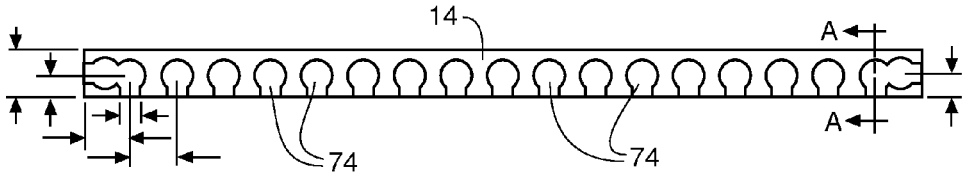
FIG. 18*b* is a back view of one embodiment of a edge wall cover that may be utilized in the polymeric veneering system of the present invention.
Figure 18C:
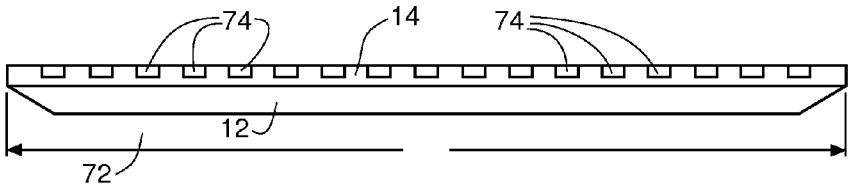
FIG. 18*c* is a top view of one embodiment of a edge wall cover that may be utilized in the polymeric veneering system of the present invention.
Figure 19A:
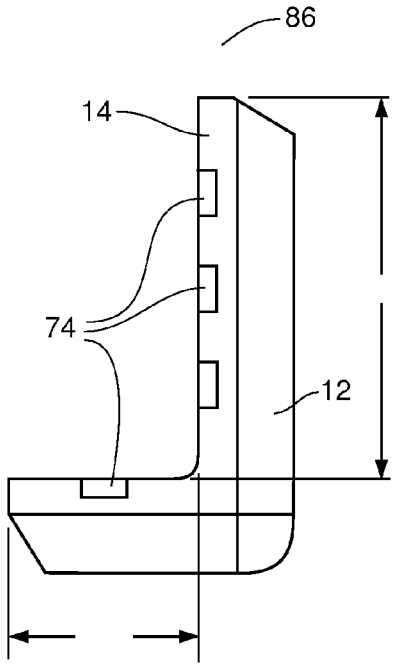
FIG. 19*a* is a top view of one embodiment of a corner edge wall cover that may be utilized in the polymeric veneering system of the present invention.
Figure 19B:
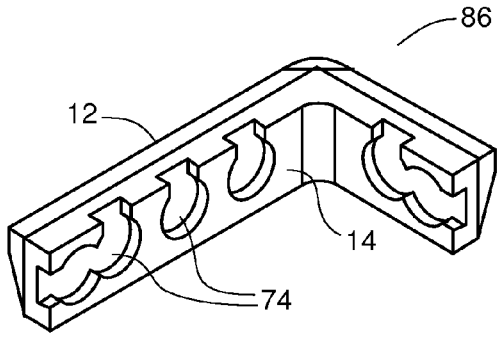
FIG. 19*b* is a back perspective view of one embodiment of a corner edge wall cover that may be utilized in the polymeric veneering system of the present invention.
Figure 19C:
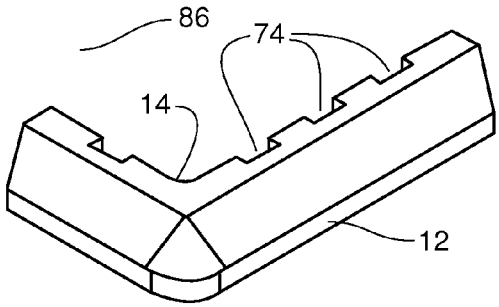
FIG. 19*c* is a front perspective view of one embodiment of a corner edge wall cover that may be utilized in the polymeric veneering system of the present invention.

FIGS. 18*a*-18*c* depict one embodiment of a molding panel 82, which operates in a similar way to the radius clip panels previously described, but may be utilized at wall or substrate edges (e.g. top, bottom, sides). The molding panel 82 generally includes a front surface 12 and a back surface 14. The back surface 14 of this embodiment supports a plurality of sockets 74 that may be utilized to accept one or more attachment members for securing the molding panel 84 to the wall, substrate and/or adjacent panels. Finally, as depicted in FIGS. 19*a*-18*c*, corner moldings 86 may be utilized to provide borders on the various corners of a wall or substrate. It is noted that all embodiments, including the barb clip embodiments, may include molding panels and corner moldings to provide a border on the wall or substrate.

Figure 20:
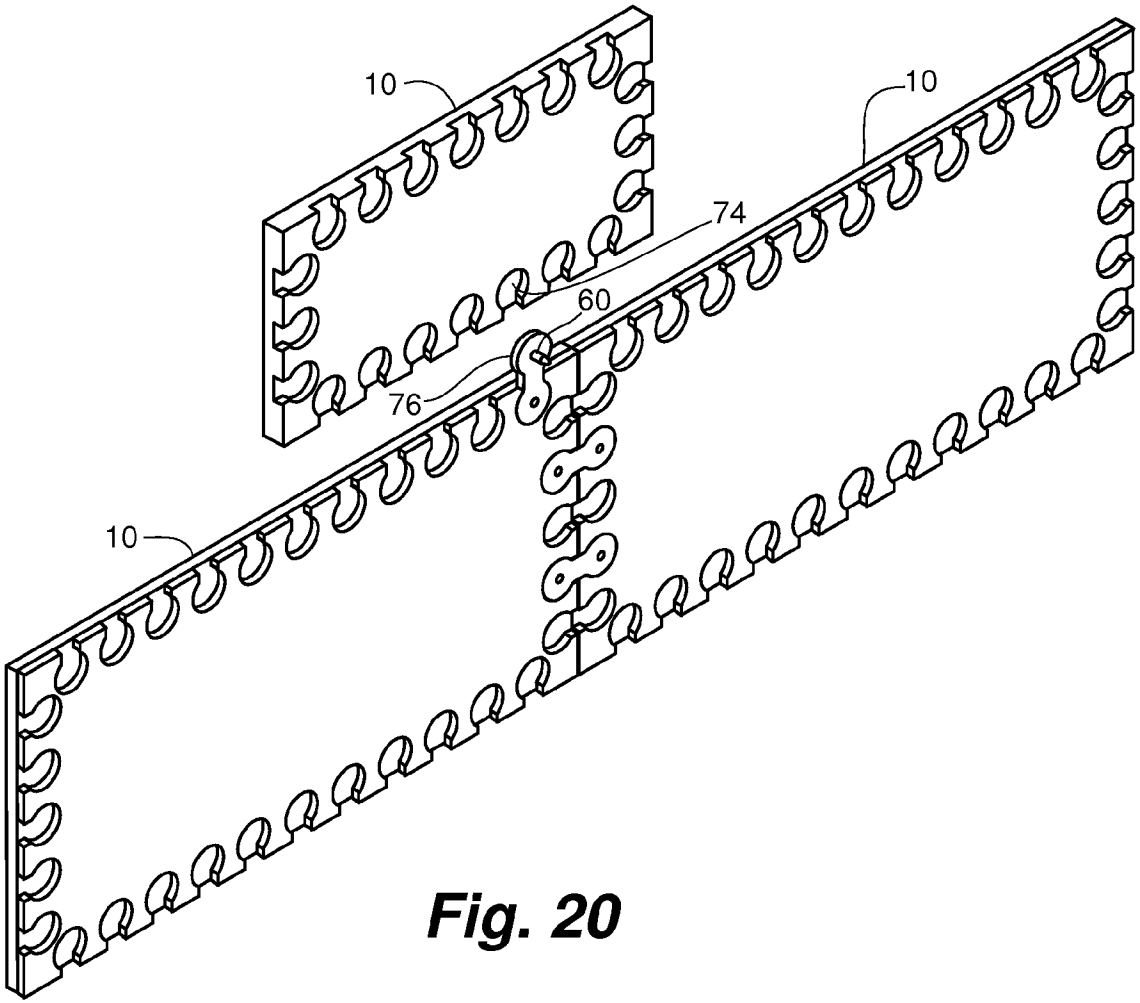
FIG. 20 is a perspective view of one embodiment of a polymeric veneering product of the present invention that is adjoined to two other panels of the present invention with a radius clip.

In operation, as depicted in the back view of FIG. 20, a molding panels (not shown) and corner panels (not shown) are secured to the base, top and/or side of a wall by radius clips 76. Once the molding is secured, a panel 10 of this embodiment is secured to a wall or substrate by first inserting one or more attachment members 78 of one or more radius clips 76 into one or more sockets 74 on the top and/or side(s) of the panel 10. It is noted the radius clip(s) 76 may optionally be adjoined to the wall or substrate first prior to inserting the attachment members 78 into the sockets 74 of the molding panels 84, corner moldings 86 or panels 10. Once the clips 76 are secured to the panel(s) 84, 86, 10, the panels are secured to the radius clips adjoined to the molding panels and corner panels and the radius clips 76 on the top and side surfaces of the panels 10 are secured to the substrate, such as a wall, with one or more fasteners 60. This process is repeated until the bottom row of the wall is secured to the wall or substrate. Once the bottom row is secured, another one or more radius clips 76 are inserted into the sockets 74 on the top edge of another panel of this embodiment and that panel is secured to a wall or substrate by inserting the attachment member 78 secured to the wall or substrate into a socket 74 on the bottom edge of a panel 10 to be attached to the wall or substrate. Next a fastener 60 is placed in the aperture of the radius clip 76 positioned on the top of the panel 10 and the radius clip 76 is fastened to the wall or substrate, thereby securing the panel 10 to the wall or substrate. This process is continued until the wall is covered with panels 10. It is noted that this process may be altered by securing the panels 10 from the top of the wall or substrate downward or securing the panels on one side of a wall or substrate and moving to the other side of the wall or substrate.

Figure 21A:
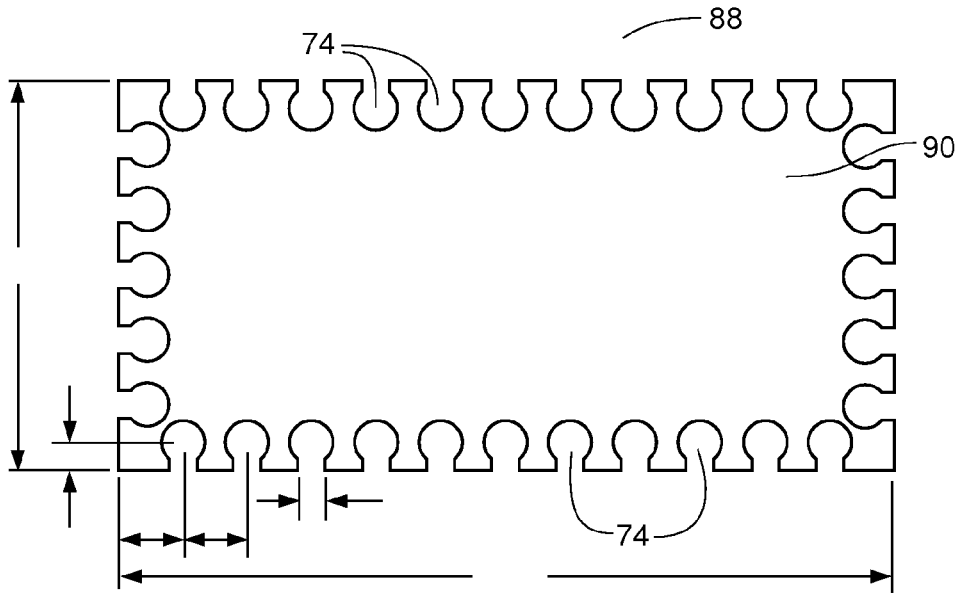
FIG. 21*a* is a front view of one embodiment of a snap grid that may be utilized in the polymeric veneering system of the present invention.
Figure 21B:
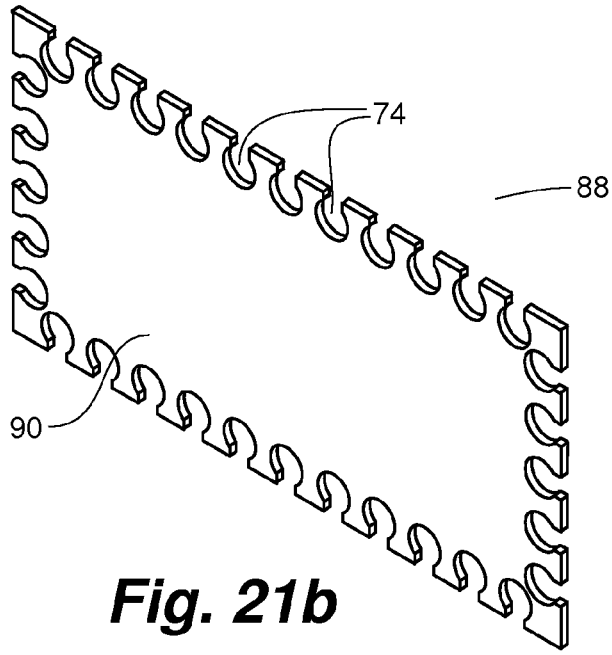
FIG. 21*b* is a front perspective view of one embodiment of a snap grid that may be utilized in the polymeric veneering system of the present invention.

In yet another embodiment of the present invention, a radius clip snap grid 88 may be secured to the wall or substrate and a panel 10 or wall cap may be secured to the snap grid 88. FIGS. 21*a* and 21*b* depict one embodiment of a snap grid 88 that may be utilized with the present invention. In general, the snap grid 88 of this embodiment includes a sheet 90 having a plurality of sockets 74 aligning one or more edges. The snap grid may be secured to the wall or substrate by any means know in the art including but not limited to screws, nails, rivets, adhesives and the like. Once secured to the wall, a panel 10 or wall cap may be adjoined to the snap grid 88 with one or more radius clip(s) 76.

Figure 22A:
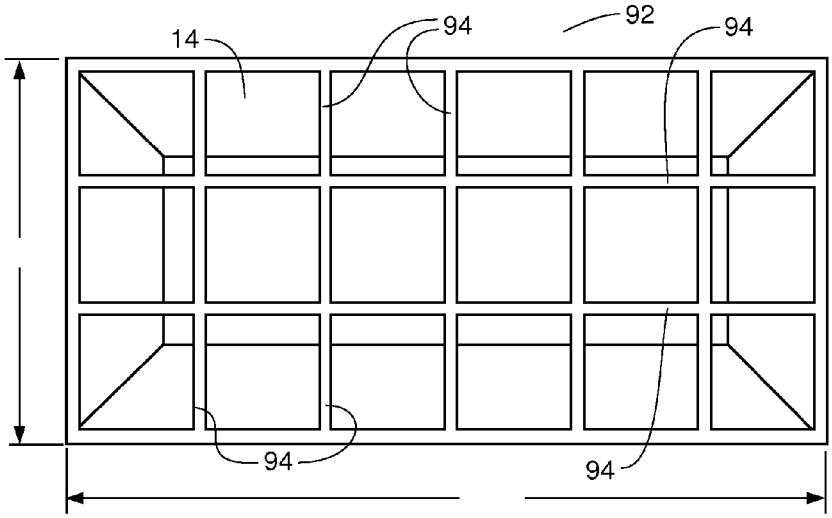
FIG. 22*a* is a back perspective view of a wall cap that may be utilized in the polymeric veneering system of the present invention.
Figure 22B:
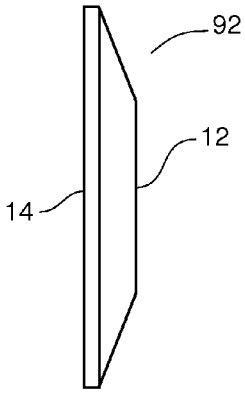
FIG. 22*b* is a side view of a wall cap that may be utilized in the polymeric veneering system of the present invention.
Figure 22C:
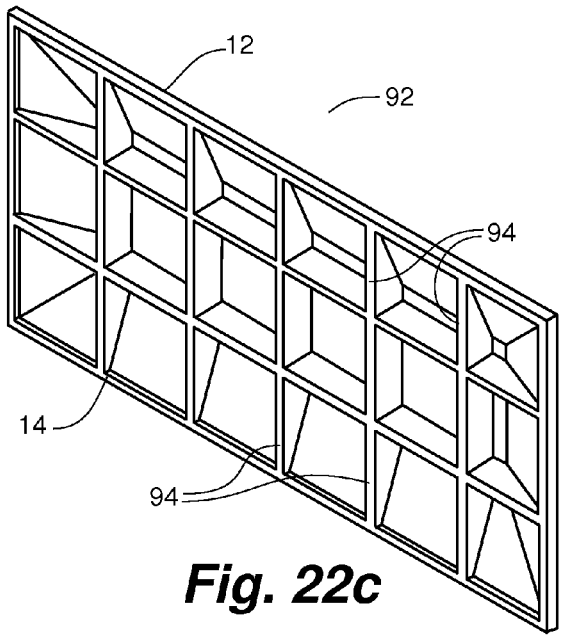
FIG. 22*c* is a back view of a wall cap that may be utilized in the polymeric veneering system of the present invention.
Figure 23A:
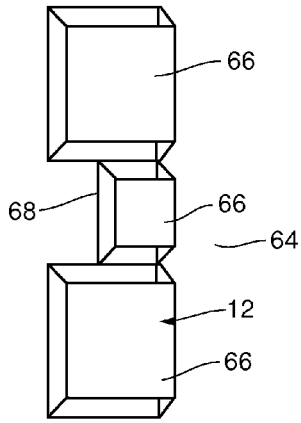
FIGS. 23*a-e* are various views of one embodiment of a corner wall cover of a polymeric veneering product of the present invention.
Figure 23B:
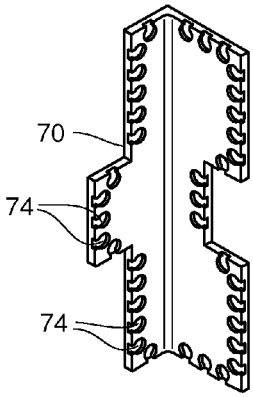
Figure 23C:
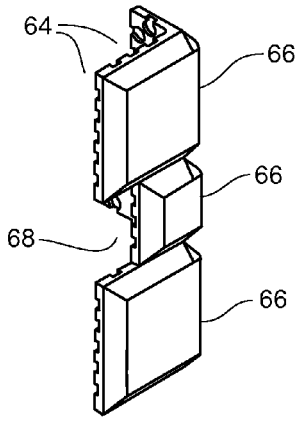
Figure 23D:
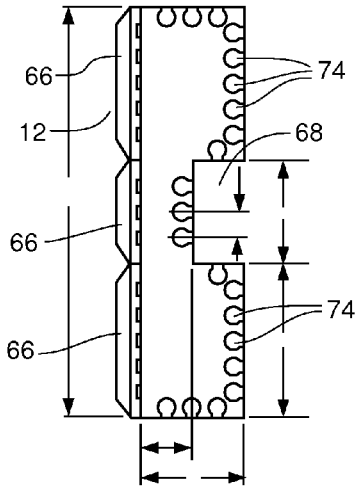
Figure 23E:
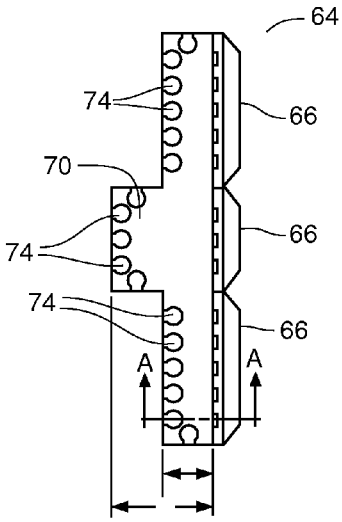
Figure 24B:
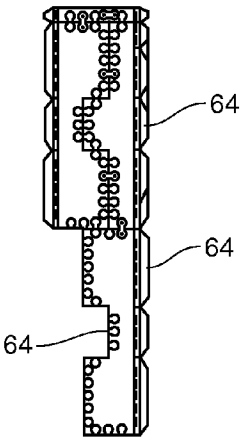
FIGS. 24*a-d* are various views of a wall covering system that includes a plurality of panels and corner panels secured by radius clips.
Figure 24C:
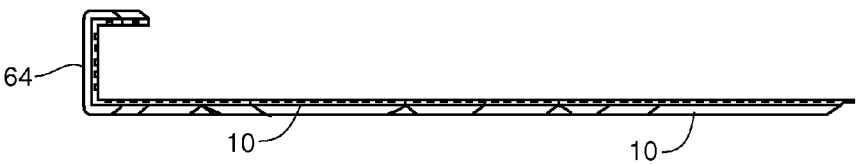
Figure 24A:
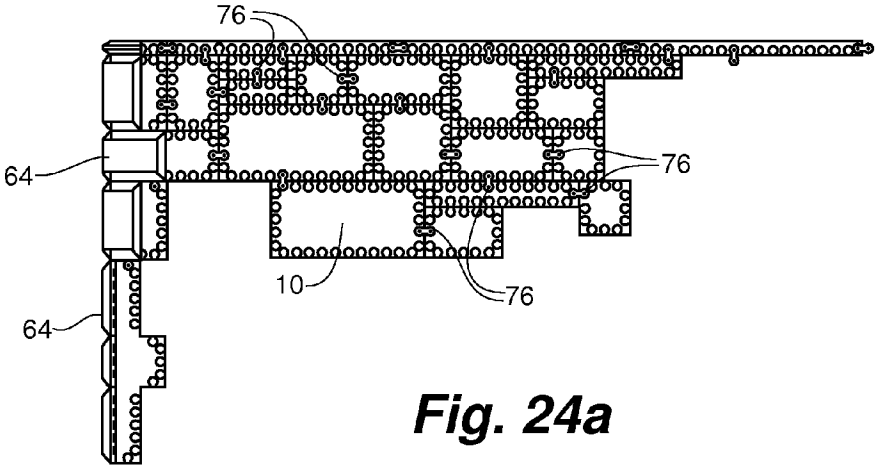
Figure 24D:
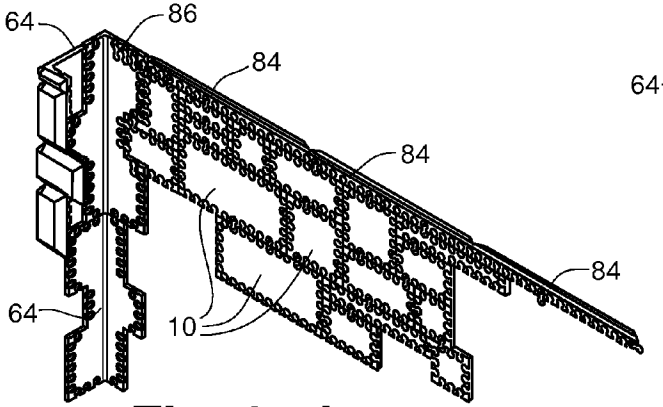

FIGS. 22*a*-22*c* depict one embodiment of a wall cap 92 that may be secured to a snap grid of the present invention. In various embodiments, the wall cap 92 includes a front surface 12 and a back surface 14. In the depicted embodiments, the back surface 14 includes a plurality of ribs 94 to provide additional stability and structure to the wall cap 92. In some embodiments, a plurality of radius clips 76 may be secured to the back surface 14 and/or ribs 94 of the wall cap 92 and subsequently snapped into the snap grid 88 already positioned on the wall.

FIGS. 23*a*-23*e* depict one embodiment of a corner panel 64 that may be utilized with the panels and radius clips 76 described above. In this embodiment, the corner panel 64 generally includes a plurality of stones 66 molded into the front surface 12. However, in other embodiments, the corner panel 64 may also be molded to feature only a single stone. In some embodiments that include a plurality of stones in a single panel, the panel may include a stone projection 68 that may intersect with one or more regular panels 10 or a recess 70 of another adjacent corner panel when covering a wrap around wall. It is noted that the recess 70 may be used to receive a regular panel 10 when covering a corner. Similar to the panels described above, the corner panel 64 includes sockets 74 that extend along the top, bottom and/or one or more sides of the corner panel 64 that may be utilized to adjoin the corner panels 64 to adjacent panels 10.

FIGS. 24*a*-24*d* depict the corner panel 64 incorporated into a wall assembly that includes a plurality of panels 10 adjoined by radius clips 76. As previously suggested, each corner panel 64 and/or each panel 10 of the present invention may take on the appearance of a single stone, rock, timber and the like or may take on the appearance of a plurality of stones, rocks, timbers and the like.

Various embodiments of the present invention may be formed in a single part by processes that have manufacturing benefits, such as injection molding, structural foam molding (e.g. low pressure multi-nozzle structural foam), injection molding using chemical and other foaming agents, extrusion, blow molding or thermoforming. In many embodiments of the present invention, the panels 10 are foamed panels manufactured utilizing a foaming process, such as structural foam molding (e.g. low pressure multi-nozzle structural foam, or injection molding using chemical and other foaming agents. Such foamed panels provide a sturdy and rigid structure that establishes a protective barrier to the substrate and is capable of sustaining high impact.

Other embodiments of the present invention may be wall covering systems formed with multiple parts. For example, a veneering system may include a plurality of panels of the present invention adjoined to a grid system or backing that has been attached to a substrate surface, such as a wall surface. In certain circumstances it may be beneficial to attach a grid system or backing, such as an attachment grid, snap grid, plywood, particle board or drywall, to the surface of a wall or other structure to support one or more panels of the present invention. For example, a wall that is uneven, such as a corrugated metal sided building or an old brick or concrete building, may require a grid system, such as metal or plastic grid, snap grid, plywood or drywall, to be attached to its surface to better accept the panels of the present invention. However, it is again noted that such a grid system or backing may not be necessary. Furthermore, a grid system or backing may be utilized to protect the substrate beneath when it is desired to limit the damage to such a substrate. For example, a grid system may be secured to drywall or a plastered wall in a limited number of attachment locations rather than the multiple locations required to adjoin a plurality of panels to the same drywall or plastered wall.

Figure 25:
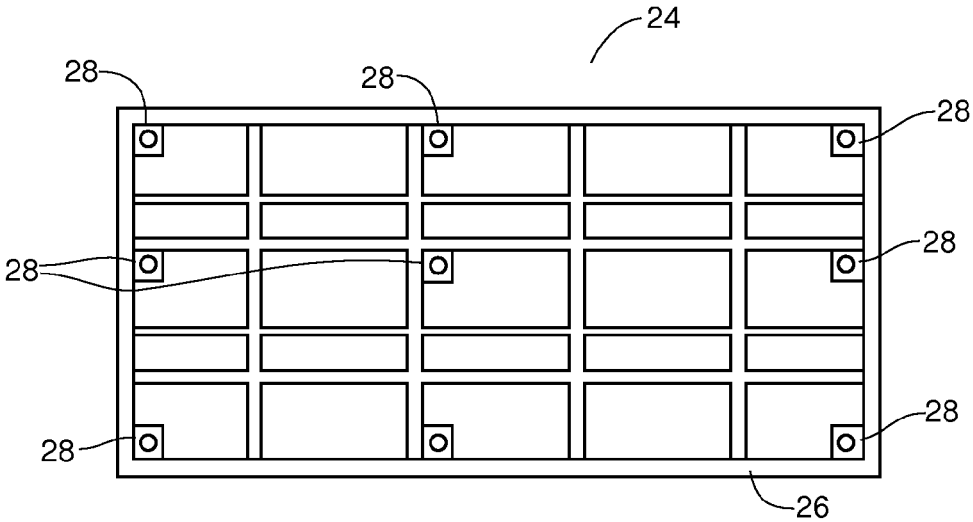
FIG. 25 is a front view of one embodiment of a substrate comprising a grid for securing one or more polymeric veneering products of the present invention to a wall or surface.

FIG. 25 depicts one embodiment of a grid system or backing 24 of the present invention. The grid system 24 of this embodiment includes a grid 26 comprising a plurality of intersecting horizontal and vertical members. The grid system 24 may be attached to a substrate, such as a wall, by utilizing one or more substrate fasteners 28. Examples of substrate fasteners 28 include, but are not limited to screws, bolts, adhesives, rivets, nails, and combinations thereof. In the example depicted in FIG. 7, the grid system 24 is adjoined to the wall surface with a plurality of screws, bolts or rivets that function as the substrate fastener 28.

Figure 26:
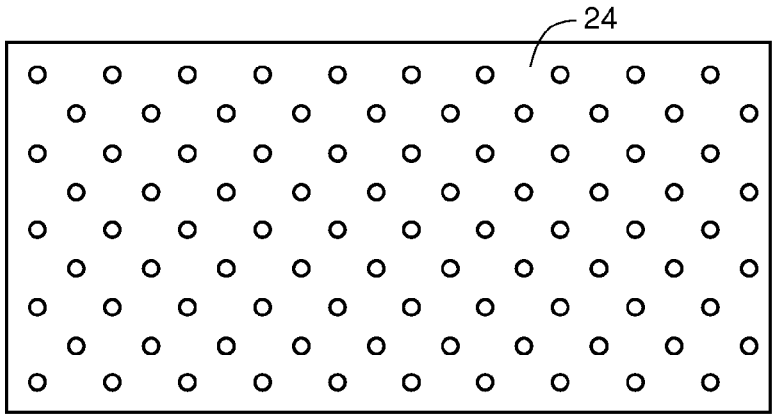
FIG. 26 is a front view of one embodiment of a substrate comprising a peg board for securing one or more polymeric veneering products of the present invention to a wall or surface.

FIG. 26 depicts another alternative grid system or backing 24 that may be utilized in the present application. The grid system 24 comprises a peg board that functions in a similar fashion as the receiving portion of LEGOS®. The panels 10 used in this embodiment would include a plurality of pegs (not shown) that would be received by the peg board of this embodiment. In an alternate, but similar embodiment of the present invention, the substrate 24 and panels 10 may include the male and female components that are similar to VELCRO®.

Figure 27:
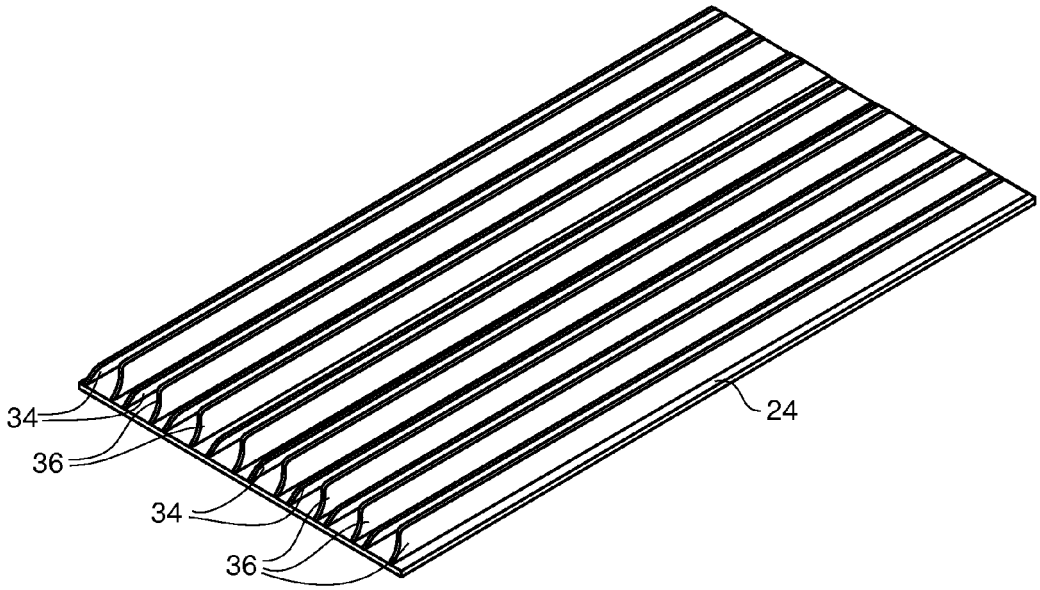
FIG. 27 is a side view of one embodiment of a substrate comprising a track system for securing one or more polymeric veneering products of the present invention to a wall or surface.
Figure 28:
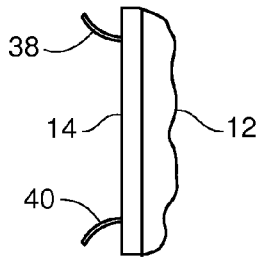
FIG. 28 is a side view of one embodiment of a polymeric veneering product of the present invention that includes a top and bottom slide member.

FIG. 27 depicts another embodiment of a grid system 24 that may be secured to a wall or other surface. In this embodiment, a grid system comprised of a series of tracks including a top slide bracket 34 and bottom slide bracket 36 are positioned on a substrate, such as a wall. The top slide bracket 34 and bottom slide bracket 36 are generally configured to receive one or more top slide members 38 and bottom slide members 40 positioned on the back surface 14 of a panel 10 as depicted in FIG. 28. It is noted that in various embodiments the one or more sets of top slide brackets and bottom slide brackets may be secured directly to the wall or surface being covered rather than securing them first to a substrate.

Figure 29:
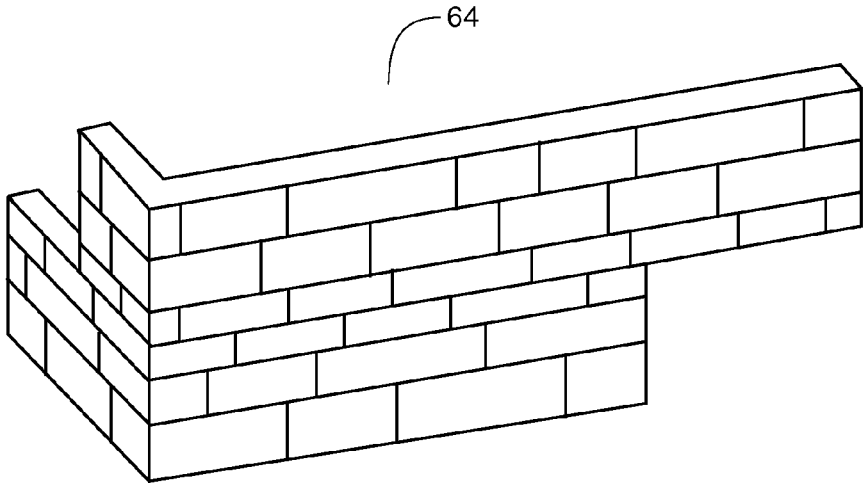
FIG. 29 is a perspective view of one embodiment of a polymeric veneering product that is configured for a corner application.
Figure 30:
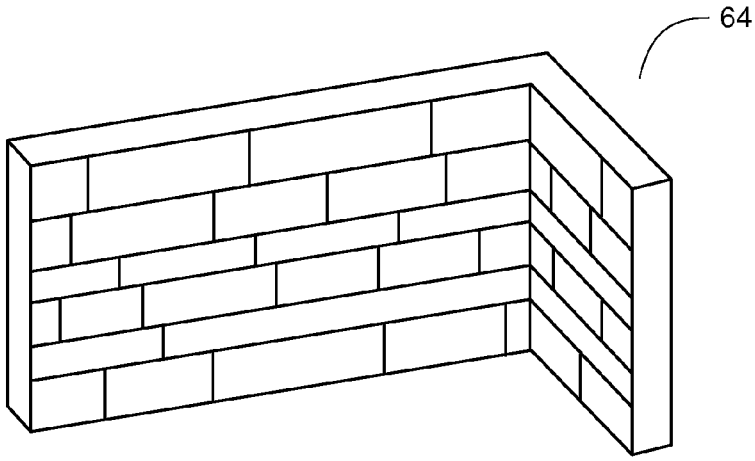
FIG. 30 is a perspective view of one embodiment of a polymeric veneering product that is configured for a corner application.
Figure 31A:
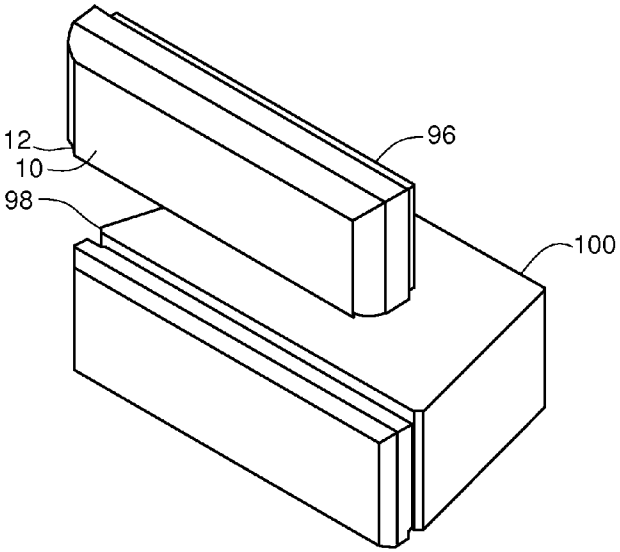
FIGS. 31*a-e* are views of a concrete segmental retaining wall block and polymeric veneering product covering.
Figure 31E:
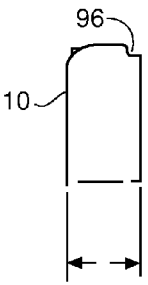
Figure 31B:
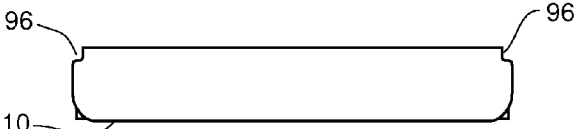
Figure 31C:
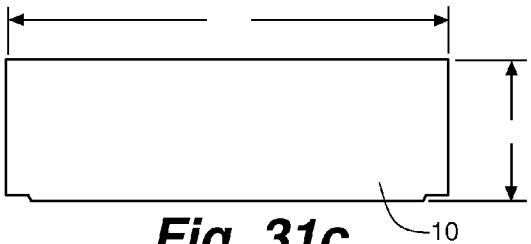
Figure 31D:
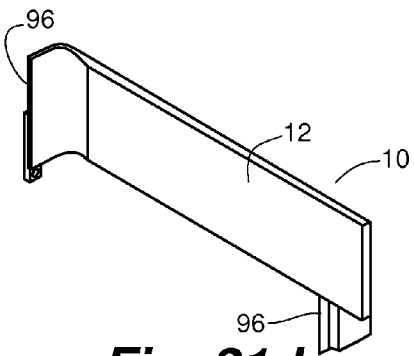

The panels of the present invention may take the form of any shape and may be of any size. For example, as previously mentioned, the panel may be shaped in a rectangle, circular, elliptical or "Z" configuration. Panels may also be shaped to wrap around corners or fit into or onto irregular shapes. FIGS. 29 and 30 depict two embodiments of corner panels 64 that can be utilized in outside and inside 90 degree corners.

The panels 10 and corner panels 64 may also be of varying size. In some embodiments of the present invention the panels 10 are greater than eight square feet. In yet other embodiments of the present invention the panels 10 are approximately two to eight square feet. In still other embodiments the panels 10 are approximately ¼ to four square feet or are ½ to 3 square feet. Additionally different size panels may be utilized to provide an irregular pattern (e.g. Ashlar or ledgestone patterns).

As previously identified, any wall may be covered with the veneering product of the present invention. For example, segmental retaining wall block may be adapted to accept and secure a veneering panel of the present invention. Such a panel would provide additional durability, deterioration resistance and aesthetic appearance to the normally problematic concrete product. FIGS. 31*a-e* depict one embodiment of the panel 10 that may be utilized to cover a concrete block. The panel 10 of this embodiment of the present invention, generally includes a front face 12 adjoined to one or more groove attachments 96. The front face 12 may be molded and/or fabricated as described herein to include a colored and textured surface that replicates a natural appearances, such as stone or wood. For example, in various embodiments of the present invention, a stone or wood plank may be imaged to capture the desired face and then coated with one or more polymer paints to capture the natural appearance. It is noted that other fabrication processes, such as in-mold decoration or solid surface coating, may be utilized in manufacturing the block panels of the present invention. In this embodiment, the panel 10 may extend around the side of a concrete block 100 wherein the one or more groove attachments 96 are configured to insert and secure into a groove 98 positioned on the concrete block 100. The groove attachments 96 and accepting grooves 98 may be of a variety of shapes and sizes.

Figure 32A:
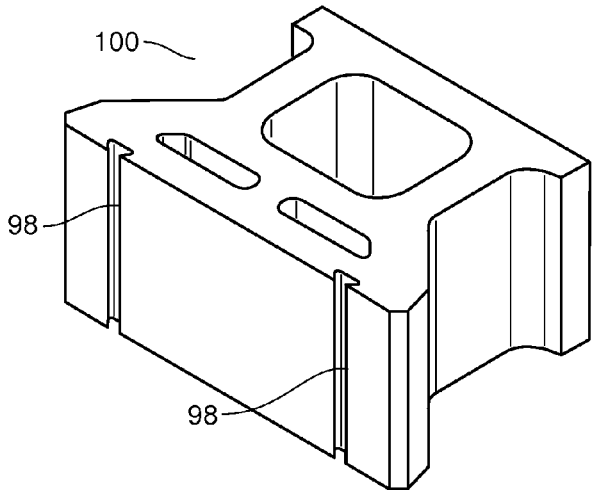
FIGS. 32*a-c* are views of a concrete segmental retaining wall block design that is adapted to receive a polymeric veneering product covering.
Figure 32C:
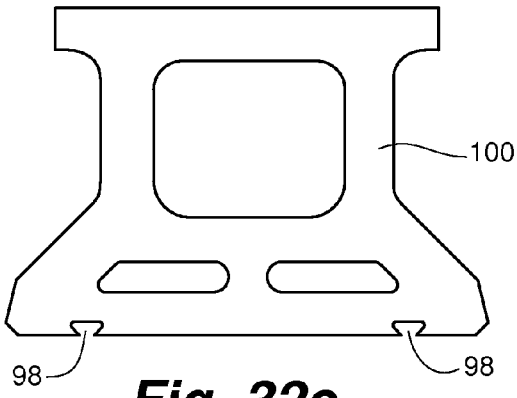
Figure 32B:
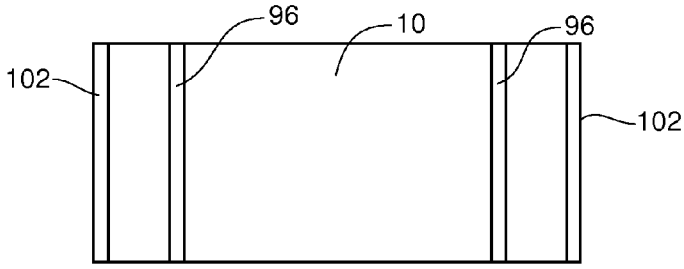

Another example of a panel 10 that may be utilized to cover concrete blocks is depicted in FIGS. 32*a-c*. In this embodiment, the groove 98 and groove attachment 96 are in the shape of a dove tail or dogbone, thereby providing for the secure attachment of the panel 10. FIG. 32*b* depicts the back view of a panel that includes two groove attachments 96 that are shaped in a dogbone configuration and a panel 10 that includes wrap around edges 102.

Each of the panels of the present invention may be textured and include color and/or other additives (e.g. U.V. inhibitor, texture enhancer, metal or glass particulates and the like) to provide protection to the panels and/or provide the desired natural appearance. Generally, the surface visible to the observer will include a molded and/or fabricated texture and/or pattern in the deterioration resistant material. In various embodiments of the present invention the exposed surface of the panel 10 will have a natural appearance. For example, the exposed surface of the front surface 12 may be textured and colored to have the appearance of rock, natural stone, sand, soil, clay, wood, trees and foliage, water, or any other natural earthen appearance. Additionally, in other embodiments, the exposed surface of the veneering product, such as the front surface 12 may further include one or more designs (e.g. symbols, company names, logos, images) that may be positioned in the natural appearance texture and color (e.g. a company logo embedded in a stone color and texture). Also, in other embodiments of the present invention, the front surface 12 may further include a design, such as the appearance of multiple bricks, stones, timbers or blocks. This allows for the installation of larger panels in a wall that appear to include a multitude of bricks, stones, blocks, timbers and the like.

In many embodiments of the present invention, the appearance of the front surface 12 the other portions of the panel 10 that are intended to be seen, generally include a natural appearance. This may be accomplished in a number of ways including but not limited to thermal molding, lamination and/or coating (e.g. solid surface coating, such as U.V. activated coating, or polymer painting). For example, the relief, texture and color of each panel 10 may be formed by thermal molding one or more resins that include colors and other additives in a mold that has a desired texture. Such a process may be performed by any process known in the art, such as thermoforming, extrusion, rotomolding, injection molding, structural foam molding, injection molding using chemical and other foaming agents, vacuum molding or any combination thereof. In many embodiments of the present invention the panels 10 are formed using a foamed process, such as structural foam molding or injection molding using foaming agents. Such parts made by using a foamed process provides a part that is durable, rigid and possesses a desirable texture. In other embodiments, the texture may also be imprinted on the panel 10 in a secondary process after formation of the panel 10 by rolling a die that imprints the texture on the polymeric front surface 12.

In other embodiments of the present invention, the natural appearance can be achieved through a lamination process. In various embodiments, a sheet of polymeric material having the desired natural appearance and including the desired color and additives (e.g. UV inhibitor, natural or synthetic stone particles . . . ) is laminated over the portions of the panel 10, such as the front face 12. In various embodiments of the present invention a sheet of polymeric material may include natural or synthetic particles (e.g. granite, marble, aluminum trihydrate, aluminum oxide . . . ). Generally, in the lamination process, the front surface 12 may have a sheet of polymeric material heat welded or adhered to the front surface 12. Such a lamination step may happen in a secondary step after formation of the panel 10. Alternatively, the laminated plastic sheet may be inserted into the front side of a mold and formed over the resin that is administered into the mold. For example, a sheet of polymeric material may be placed in the front end of an injection molding mold and subsequently thermoformed or vacuum formed to the front surface of the mold prior to filling the mold with resin when manufacturing the panel 10. Next, melted resin is shot into the injection mold, thereby integrating the laminated sheet into the front of the panel 10 and optionally top of the other parts of the panel 10 intended to be seen.

In yet other embodiments of the present invention, the natural appearance may be achieved by utilizing a solid surface coating. The solid surface coating generally includes one or more natural mineral or fiber fillers, one or more polymeric binder resins and one or more initiators. The natural mineral or fiber fillers may include but are not limited to natural stone or rock filler (e.g. granite, marble, quartz, limestone, shale particles), wood fiber, hydrated alumina (e.g. aluminum trihydrate), ground silica, acrylic chips, calcium carbonate, aluminum oxide with pigmented polymer coated quartz, sand, and any other filler that would provide a natural stone, brick or wood appearance.

Various embodiments of the present invention include one or more polymerizable binder resins. In one embodiment, the present invention provides a system comprising initiators and one or more polymerizable binder resins, each binder resin bearing one or more polymerizable groups. In accordance with this embodiment, the photoinitiator group serves to initiate polymerization of the polymerizable groups, thereby forming a polymeric coating, e.g., in the form of a layer covalently bound to the front surface of the panel via the one or more initiators. As used herein, "polymerizable group" shall generally refer to a group that is adapted to be polymerized by initiation via free radical generation, and more preferably by photoinitiators activated by visible or long wavelength ultraviolet radiation.

Suitable polymerizable compounds are selected from monomeric polymerizable molecules (e.g., organic monomers), and macromeric polymerizable molecules (e.g., organic macromers). As used herein, "macromer" shall refer to a macromolecular monomer having a molecular weight of about 250 to about 25,000, and preferably from about 1,000 to about 5,000. For purposes of the present invention, and unless specified otherwise, the term "monomer" when used in this respect shall generally refer to monomeric and/or macromolecular polymerizable molecules.

In yet another embodiment, the polymerizable monomer compounds of the present invention comprise macromeric polymerizable molecules. Suitable macromers can be synthesized from monomers such as those illustrated above. According to the present invention, polymerizable functional components (e.g., vinyl groups) of the macromer can be located at either terminus of the polymer chain, or at one or more points along the polymer chain, in a random or nonrandom structural manner.

Examples of some polymerizable binder resins that may be utilized in the present invention include, but are not limited to, polyurethanes, polyepoxides, epoxy-acrylates, epoxide and epoxy resins, urethane acrylates, methacrylates, unsaturated polyesters, polyols, acrylics and monomers and oligomers having similar backbone structures of these resins.

The coatings also include one or more initiators. Generally the initiators are polybifunctional reagents of the invention carry one or more pendent latent reactive (e.g. photoreactive or thermoreactive) moieties covalently bonded to the resin. Various embodiments of the coatings of the present invention include one or more photoreactive moieties that are sufficiently stable to be stored under conditions in which they retain such properties. Latent reactive moieties can be chosen that are responsive to various portions of the electromagnetic spectrum, with those responsive to ultraviolet and visible portions of the spectrum (referred to herein as "photoreactive") being particularly preferred.

Photoreactive moieties respond to specific applied external stimuli to undergo active specie generation with resultant covalent boding to an adjacent chemical structure, e.g., as provided by the same or a different molecule. Photoreactive moieties are those groups of atoms in a molecule that retain their covalent bonds unchanged under conditions of storage but that, upon activation by an external energy source, form covalent bonds with other molecules.

The photoreactive moieties generate active species such as free radicals and particularly nitrenes, carbenes, and excited states of ketones upon absorption of external electric, electromagnetic or kinetic (thermal) energy. Photoreactive moieties may be chosen to be responsive to various portions of the electromagnetic spectrum, and photoreactive moieties that are responsive to e.g., ultraviolet and visible portions of the spectrum are preferred and are referred to herein occasionally as "photochemical" moiety.

Photoreactive aryl ketones, such as acetophenone, benzophenone, anthraquinone, anthrone, and anthrone-like heterocycles (i.e., heterocyclic analogues of anthrone such as those having N, O, or S in the 10-position), or their substituted (e.g., ring substituted) derivatives are utilized in some embodiments of the present invention. The functional groups of such ketones are preferred since they are readily capable of undergoing the activation/inactivation/reactivation cycle described herein. Benzophenone is one photoreactive moiety that may be utilized, since it is capable of photochemical excitation with the initial formation of an excited singlet state that undergoes intersystem crossing to the triplet state. The excited triplet state can insert into carbon-hydrogen bonds by abstraction of a hydrogen atom (from a support surface, for example), thus creating a radical pair. Subsequent collapse of the radical pair leads to formation of a new carbon-carbon bond. If a reactive bond (e.g., carbon-hydrogen) is not available for bonding, the ultraviolet light-induced excitation of the benzophenone group is reversible and the molecule returns to ground state energy level upon removal of the energy source. Photoactivatable aryl ketones such as benzophenone, thioxanthone, camphorpyinone and acetophenone are of particular importance inasmuch as these groups are subject to multiple reactivation in water and hence provide increased coating efficiency.

Other initiator may include one or more photointiated reagents including four or more reactive groups. Examples of such initiators include tetrakis (4-benzoylbenzyl ether), the tetrakis (4-benzoylbenzoate ester) of pentaerythritol, and an acylated derivative of tetraphenylmethane.

The azides constitute another class of latent reactive moieties and include arylazides ($C_6R_5N_3$) such as phenyl azide and particularly 4-fluoro-3-nitrophenyl azide, acyl azides (—CO—$N_3$) such as benzoyl azide and p-methylbenzoyl azide, azido formates (—O—CO—$N_3$) such as ethyl azidoformate, phenyl azidoformate, sulfonyl azides (—$SO_2$—$N_3$) such as benzenesulfonyl azide, and phosphoryl azides $(RO)_2PON_3$ such as diphenyl phosphoryl azide and diethyl phosphoryl azide. Diazo compounds constitute another class of photoreactive moieties and include diazoalkanes (—$CHN_2$) such as diazomethane and diphenyldiazomethane, diazoketones (—CO—$CHN_2$) such as diazoacetophenone and 1-trifluoromethyl-1-diazo-2-pentanone, diazoacetates (—O—CO—$CHN_2$) such as t-butyl diazoacetate and phenyl diazoacetate, and beta-keto-alpha-diazoacetates (—CO—$CN_2$—CO—O—) such as t-butyl alpha diazoacetoacetate. Other photoreactive moieties include the aliphatic azo compounds such as azobisisobutyronitrile, the diazirines (—$CHN_2$) such as 3-trifluoromethyl-3-phenyldiazirine, the ketenes (—CH═C═O) such as ketene and diphenylketene.

The solid surface coating may be applied to the surface of the veneering product of the present invention by any type of process that would provide substantial coverage of the product surface and secure attachment of the coating, such as spray coating, dip coating and the like. In various embodiments of the present invention, the solid surface coating may be administered to the product surface in a one step or two step process. For example, in a one step process, a substantially homogenous mixture of the filler, polymerizable resin and initiators are administered to the surface of the product and the initiators then subsequently activated to polymerize the resin and attach the coating to the surface.

Alternatively, a two step or grafting process may be utilized to administer the solid surface coating. In such a process, the initiator is first administered to the surface and activated to attach the initiator to the surface. Once the initiator is attached, a substantially homogenous mixture of the filler and polymerizable resin is administered to the surface and the initiator is again activated to polymerize the resin and attach the mixture to the surface. It is noted that in various embodiments of the present invention, a tie-in layer may be applied to the surface to facilitate better attachment of the solid surface coating. For example, one or more layers, such as a silane, siloxane and/or Parylene layer(s) may be applied to the surface prior to administration of the solid surface coating.

In other embodiments of the present invention, the veneering products may be colored and further textured utilizing a painting process. One such painting process that may be used with various embodiments of the present invention is a polymer adhesion painting process wherein a polymer adhering paint is applied to the surface of the veneering product. In some embodiments of the present invention the polymer adhering paint is applied to the front surface 12 after the front surface 12 has been flame treated or plasma or corona treated. Alternatively, adhesion promoters may be utilized to promote adhesion of the polymer paints rather than flaming, plasma or corona treatment. However, it is noted that the adhesion promoter may be included in the base coat or may be the base coat applied to the front surface 12.

In various embodiments of the present invention the polymer adhering paint may be a solvent or water based paint. Examples of such paints are identified below. However, many of the embodiments of the present invention utilize a polymer adhering paint that has a very low gloss. For example, in embodiments of the present invention the gloss rating of the paint utilizing a 60° gloss meter is less than 5 and may be between 0 and 4. In various embodiments the gloss is between 1 and 3.

In one polymer adhesion painting method, the front surface 12 of the panel 10 is manufactured utilizing a process, such as injection molding, structural foam molding (e.g. low pressure multi-nozzle structural foam), injection molding using chemical and other foaming agents, rotomolding, thermoforming, extrusion or any other process. Next, all surfaces of the panel 10 intended to be painted may be flame treated, plasma or corona treated or treated with adhesion promoter prior to applying paint. The flame treating may be performed with any gas torch system, such as propane, acetylene and the like. Plasma treatment may also be performed by any device that forms a gas plasma that can be directed to the polymeric surface. The flame or plasma treated surface should be painted within 24 hours, optionally within 8 hours and further optionally within 5 hours. Once the surface has been flame, plasma, corona, or adhesion promoter treated, a polymer adhering paint, such as a polyurethane based paint mixed with a crosslinker or a waterbase paint is applied to the surface or surfaces of the panel 10. It is noted that the polymer adhering paint mixture should be applied shortly after mixing; in some embodiments almost immediately.

One example of the types of polymer paints that may be utilized with embodiments of the present invention is a two-component polyurethane that generally includes a mix ratio of three to five parts colored paint with one to two parts crosslinker (e.g. XL-003 crosslinker or an isocynate). Two examples of two such polyurethane based paints are as follows:

EXAMPLE 1

| HIGH SOLIDS ALLPHATIC POLYURETHANE<br>120 Series | |
|---|---|
| DESCRIPTION | |
| High Solids 3.5 V.O.C. two component polyurethane for metal, plastic, and interior wood. It is used for industrial and automotive applications. This system has excellent chemical and stain resistance. It has shown excellent adhesion to many substrates with good mar and abrasion resistance and it has 2-3H hardness. | |
| CHARACTERISTICS | |
| Density - lbs/gal: | 7.95-13.0 |
| Solids, wt. %: | 51-70 |
| Solids, volume: | 42.9-60 |
| Viscosity: | 35-42 Sec. |
| Flash Point ° F. | 80 |
| Application Method: | Conventional of HVLP |
| Reduction for Application: | 5-base; 1-XL009; 1-acetone<br>6-base; 1-XL003; 1-20LT161 |
| Pot Life: | 3-HRS @ 70° F. |
| Cure Schedule: | 30 min @ 180° F. |
| Gloss 60°: | Flat to 96 |
| VOC as supplied - lbs/gallon: | 3.0-3.6 |
| VOC as applied - lbs/gallon: | 2.9-3.5 |

EXAMPLE 2

| MEDIUM SOLIDS ALLPHATIC POLYURETHANE<br>121 Series | |
|---|---|
| DESCRIPTION | |
| The 121 Series is a medium solids, low temperature cure two component polyurethane for use on metal and plastic. It is used for industrial and automotive applications. This system has excellent chemical, stain, and water soak resistance. It has good adhesion to many substrates with good mar and abrasion resistance and it has 2H hardness. | |
| CHARACTERISTICS | |
| Density - lbs/gal: | 7.92-11.0 |
| Solids, wt. %: | 45-67 |
| Solids, volume: | 37-48 |
| Viscosity: | 45 sec Zahn#2 |

-continued

| MEDIUM SOLIDS ALLPHATIC POLYURETHANE 121 Series | |
|---|---|
| Flash Point ° F. | 78 |
| Application Method: | HVLP; Conv. |
| Reduction for Application: | 4-base; 1-XL009<br>5-base; 1-XL003 |
| Pot Life: | 2 hrs @ 70° F. |
| Cure Schedule: | 35 min @ 160° F., Air Dry<br>tack free 40 min |
| Gloss 60°: | Flat to 96 |
| VOC as supplied - lbs/gallon: | 3.6-4.3 |
| VOC as applied - lbs/gallon: | 3.37-4.0 |

Both polymer adhesion paints of Examples 1 and 2 are manufactured and distributed by:
PRIME COATINGS
1002 Hickory Street
Pewaukee, Wis. 53072
www.primecoatings.net
Telephone: (262) 691-1930

Alternative polymer adhesion paints that may be utilized with the present invention include solvent based paints and waterborne paints produced for low surface energy polymers, such as polypropylene and polyethylene. Examples of such solvent and water based paints that may be utilized with the cells of the present invention include, but are not limited to the polyurethane based paints (e.g. 2K High Solids Urethane Base Coat products) produced by Redspot Paint & Varnish Company, Inc. of Evansville, Ind. or the polyurethane, waterborne or powder based paints, such as Polane® Polyurethane Systems, Polane® or Kem® AquaWaterborne Systems, Powdura® Powder Coating Systems, all produced by Sherwin Williams. Two examples of waterborne paints that do not require flame, plasma or corona treatment of the panel surface prior to application are as follows:

EXAMPLE 3

| NuBond ™ | |
|---|---|
| DESCRIPTION | |
| The NuBond ™ (ID Code: AWOR-1208) is a medium solids, low VOC waterborne coating for use on metal and plastic. It is used for industrial and automotive applications. This system has excellent chemical, stain, and water soak resistance. It has good adhesion to many substrates with good mar and abrasion resistance. | |
| Code | AWOR-1208 |
| Description | One-Component Waterborne Coating for TPO |
| Name of Product | Stone White |
| Color No. | N/A |
| Packaged Viscosity | 30-40 seconds #3 Zahn (EZ) Cup |
| Weight/Gallon | 9.36 ± 0.50 |
| % Weight Solids | 43.34 ± 2.00 |
| % Volume Solids | 34.98 ± 2.00 |
| % Gloss | 2.0-2.2 on a 60° glossmeter |
| Package V.O.C. | 1.81 ± 0.15 lb/gal (minus exempt)<br>0.83 ± 0.15 lb/gal (including exempt) |
| Method of Application | HVLP or Conventional Spray |
| Application Viscosity | As is |
| Reduction | Up to 5% with water |
| Thinner | Water |
| Substrate | TPO and/or Polypropylene |
| Clean-up Thinner | Water until dry/switch to MEK |
| Curing Conditions | 30 minutes @ 200° F. |
| Flash Time | 3-5 minutes |
| Dry Film Thickness | 1.0 ± 0.2 mils |

EXAMPLE 4

| NuBond ™ | |
|---|---|
| DESCRIPTION | |
| The NuBond ™ (ID Code: AWOR-2447) is a medium solids, low VOC waterborne coating for use on metal and plastic. It is used for industrial and automotive applications. This system has excellent chemical, stain, and water soak resistance. It has good adhesion to many substrates with good mar and abrasion resistance. | |
| Code | AWOR-2447 |
| Description | One-Component Waterborne Coating for TPO |
| Name of Product | Stone Gray |
| Color No. | N/A |
| Packaged Viscosity | 30-40 seconds #3 Zahn (EZ) Cup |
| Weight/Gallon | 9.25 ± 0.50 |
| % Weight Solids | 42.60 ± 2.00 |
| % Volume Solids | 34.85 ± 2.00 |
| % Gloss | 2.0-2.2 on a 60° glossmeter |
| Package V.O.C. | 1.85 ± 0.15 lb/gal (minus exempt)<br>0.85 ± 0.15 lb/gal (including exempt) |
| Method of Application | HVLP or Conventional Spray |
| Application Viscosity | As is |
| Reduction | Up to 5% with water |
| Thinner | Water |
| Substrate | TPO and/or Polypropylene |
| Clean-up Thinner | Water until dry/switch to MEK |
| Curing Conditions | 30 minutes @ 200° F. |
| Flash Time | 3-5 minutes |
| Dry Film Thickness | 1.0 ± 0.2 mils |

Both polymer adhesion paints of Examples 3 and 4 are manufactured and distributed by:
United Paint, Inc.
24671 Telegraph Road
Southfield, Mich. 48033-3035
Tel: 248.353.3035
Fax: 248.353.4865
www.unitedpaint.com The polymer adhering paints may further include one or more additives to provide additional beneficial characteristics. For example, additional texture may be applied to the surface of a panel 10 by including additives to the paint in fine, medium or course particulate form. Such particulate additives may be selected from any suitable texture additives such as mica, sand, perlite, pumice, silica, metal, acrylic or glass beads and fibers, or any other paint texture additive. The paint additives may be included in the paint or applied in the painting process. For example, paint textures such as mica, sand, pumice and the like may be propelled (e.g. propelled toward the surface using a device, such as a sandblaster) or sifted (e.g. sprinkled onto the surface using a sieve) onto the surface of the panel while simultaneously applying the base coat and/or secondary coat(s) of paint. Such a process disperses and entraps the texture in the coating, thereby giving a fine, medium or course textured surface.

The polymer adhesion paints may be applied in any manner known in the art including, but not limited to, spraying, dipping, brushing, sponging and any other paint application method. In various embodiments polymer adhesion paint is applied by spraying. Generally, less than 10 mils of paint are applied to the surface intended to be painted. In other embodiments less than 5 mils of paint is applied and in other embodiments less than 5 mils of paint is applied to the surface intended to be painted. In various examples, approximately 0.2 to 2.5 mils or 0.5 to 1.5 mils dry film thickness of base color was applied to the entire surface of panels. Once the base paint has been applied, secondary colors may optionally be applied to the wet or dry base coat as desired. Such secondary colors may be applied in similar ways as the base paint, such as spraying, dipping, brushing, sponging and any other spray technique known in the art. It is also noted that a primer layer may be applied to the substrate surface prior to applying the paints described herein. For example, a coating of binel, parylene or another primer coat may be applied to the surface prior to applying the paint to promote optimum adhesion.

Once the paint has been applied to the desired surface of the veneering panels, the product is then cured. In various embodiments of the present invention, the product is oven cured following painting at a temperature of 220° F. and less (e.g. 175° F. to 220° F.); in other embodiments 185° F. and less (e.g. 150° F. to 185° F.); and in still other embodiments 160° F. and less (e.g. 100° F. to 150° F.). In various embodiments the paint, is cured at the above mentioned temperatures for a period of 2 minutes to 4 hours; in other embodiments 5 minutes to 2 hours and in still other embodiments 5 minutes to 30 minutes. The product is then allowed to air dry. Once air dried, the veneering products are ready for installation. It is noted that the curing process may be performed at room temperatures, but the curing time usually will be lengthened accordingly.

Again, as previously mentioned the solid surface coating, a polymeric sheet or polymer adhesion paint may be administered or laminated to any veneering product comprised of a deterioration resistant material (e.g. plastic resin, thermoset, fiberglass, etc.). In such embodiments, the solid surface coating, polymeric sheet or polymer adhesion paint is applied to one or more surfaces of the veneering product.

As previously mentioned, the veneering products of the present invention may be manufactured from a deterioration resistant, substantially rigid composite or polymeric material including, but not limited to, plastic (e.g. recycled or virgin), a rubber composition, fiberglass, or any other similar material or a combination thereof. Preferable materials comprise light-weight and slightly flexible polymers, such as high and low density polyethylene (HDPE or LDPE) and polypropylene (PP). It is noted that a polypropylene copolymer may be utilized with the present invention, but it is recommend that the polypropylene copolymer have a polyethylene content no greater than 30% polyethylene and in other embodiments no greater than 20% polyethylene. However, other plastics may also be used. Examples of other plastics include, but are not limited to acrylonitrile-butadiene-styrene (ABS), poly(butylene terephthalate) (PBT), poly(cyclohexanedimethylene terephthalate) (PCT), styrene-acrylonitrile copolymers (SAN), polystyrene, polycarbonate, polyvinyl chloride (PVC), polyurethane, copolymers and combinations thereof. It is also noted that the deterioration polymeric materials may also be utilized with filler materials or recycled filler materials, such as titanium, carbon fibers, talc, glass, saw dust, cellulose fibers, paper byproducts and the like. Generally, the embodiments of the present invention may comprise any type of material that would have the similar characteristics to plastic, vinyl, silicone, fiberglass, rubber or a combination of these materials.

One other material that may be utilized with the present invention may be a thermoset. For example, a bulk molding compound (BMC) or thermoset that includes one or more polyester resins, glass fibers and other additives may be utilized to manufacture one or more components of the present invention. Various embodiments of thermosets and BMC is manufactured and/or molded by Bulk Molding Compounds, Inc. 1600 Powis Court West, Chicago Ill. 60185 and Kenro Incorporated, a Carlisle Company, 200 Industrial Drive, Fredonia, Wis. 53021.

It is noted that the material utilized in the present invention should be rigid enough to hold its form upon installation, impact and/or when placed in contact with other objects. Another material may be comprised of a material similar to that utilized in the production of some types of garbage cans or the utilization of recycled rubber from objects such as tires. Such materials would be capable of holding rigidity and still offer flexibility upon impact. Also, such materials have the ability to regain its original form when the impact force has been removed or completed.

Embodiments of the present invention may also vary in appearance. Since embodiments of the present invention may be manufactured by a process such as injection molding, structural foam molding, injection molding using chemical and other foaming agents, extrusion, thermo-forming, compression molding, roto-molding and the like, the molds may include any type of design, size and shape. Furthermore, the front surfaces 12 of the panels 10 could be molded in almost any type of texture, relief and/or configuration. For example, the panels may be designed to appear like a plurality of field stones, cut stones, bricks, wood planks, or any other natural wall construction material. In other embodiments, multiple panels 10 could be molded to include designs that, when positioned on a retaining wall, would complete a larger single design, such as the spelling of a company or school name in large letters or the completion of a large image. It is noted that embodiments of the present invention may also be used in conjunction with other wall products, such as vinyl siding, bricks, stones and the like.

Furthermore, since the present invention may be manufactured from and/or include a number of different products, such as plastic, a rubber composition or fiberglass, the panels may include any color or a multitude of colors. The utilization of any color or a multitude of colors in the veneering products of the present invention allows ease in matching colors with the conventional wall building materials or surroundings because the materials utilized to manufacture the present invention can be colored and designed to match virtually any type of wall construction material or surrounding environment. For example, the panels of a wall installed in a beach setting may be manufactured of a plastic or rubber product and be colored to take on the appearance of sand or natural stone walls.

As previously suggested the veneering product of the present invention may be utilized in the construction of any type of wall or surfacing project wherein a natural appearance, such as stone, brick or wood, is desired. In application, a substrate surface may be veneered with various panel 10 embodiments of the present invention by applying one or more of the panels to a surface of a substrate. In a number of embodiments of the present invention the process begins by preparing the substrate to be resurfaced by cleaning the substrate surface. The substrate surface may be a wall, such as an existing wall that is substantially planar and made of one or more materials, such as wood, drywall, masonry, sheathing, sheet metal, insulation (e.g. foam insulation), poured concrete, cinder and concrete block, segmental retaining wall block, brick and the like. In other embodiments, the substrate may be prepared by securing a grid system or backing to the substrate surface. Upon identifying the substrate, one or more panels are administered to the surface of the substrate or an attached grid system or backing previously applied to the substrate surface.

In various embodiments of the present invention a pattern can first be placed on the substrate surface to be covered with panels of differing shapes. For example, a pattern, such as an Ashlar pattern may be applied to the wall by a rubbing or stencil, thereby leaving an image of the desired placement positions of the various shaped panels. Once the stencil pattern is administered to the wall or surface, the equivalent shaped and sized panel is applied to the pattern similar to the placement of puzzle pieces in a jigsaw puzzle. It is noted that more than one pattern may be applied to the same wall thereby giving a random final appearance.

The panels of the present invention may be administered to the surface or the grid system or backing by one for more fasteners, such as adhesives, rivets, screws, nails, two sided tapes, ball and socket attachments, snaps, hook and pile attachments, sliding brackets, clipping devices (e.g. barb clip and radius clips) sliding brackets, structural VELCRO® or other attachment means known in the art that would secure the panels of the present invention to the substrate or grid system or backing. It is noted that combinations of the fasteners may also be utilized to secure the panels of the present invention. For example, various embodiments may utilize a combination of screws, nails or rivets with one or more adhesives to secure the panels to a substrate or the grid system or backing.

In a number of embodiments of the present invention each panel is adhered to the substrate and/or adjacent panel with a two sided tape that includes an adhesive that has an affinity to polymeric materials. For example various embodiments of the panels may be secured with adhesives, such as the two sided VHB and acrylic or polyurethane foam tapes produced by 3M. In such embodiments of the present invention, the two sided tape may be adhered to the attachment platforms on the back surface of each panel. The backing of the two sided tape is removed and the panel is attached to the wall or substrate in the desired location. Examples of such tapes that may be utilized with the panels 10 of the present invention include 4952, 5952, 5925 and 5962 VHB two sided adhesive tapes manufactured by 3M, 3M Center, St. Paul, Minn. 55144-1000. Another adhesive tape that may be utilized includes, but is not limited to, the 4466W Double Coated Polyethylene foam tape manufactured by 3M. Other examples of suitable two sided tapes that may be utilized with the panels of the present invention include, but are not limited to, 3M® Double Coated Polyethylene Foam Tape 4492W and 4462W, 3M® VHB® Acrylic Foam Tape 5952 and 5925 and 3M® Double Coated Urethane Foam Tape 4016. Additionally adhesive sealants, such as the 4000 and 5200 sealants produced by 3M may also be used to secure the panels 10 to a substrate, such as a wall. The sealants may be applied on the substrate surface or on the back surface of the panel prior to pressing the panel to the surface of the substrate by any means known in the art (e.g. spraying or spreading). However, it is important that the adhesive (e.g. tape or sealant) utilized be appropriate to adhere a resin based product. The examples listed above provide this feature. In general, the curing of the adhesive properly affixes the panel to the substrate. Curing times vary depending on the adhesive, but many will cure within less than 72 hours.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

The invention claimed is:

1. A polymeric veneering panel comprising:

one or more polymeric materials and having a front surface including a plurality of natural surface images having texture and relief that is obtained by imaging one or more natural surfaces;

at least three or more fields that extend partially along the perimeter of the panel and further extend through the interior of the panel, each of the fields being broken by at least one natural surface image;

a hollowed back surface; and one or more attachment platforms adapted to accept one or more fastening devices for adjoining the panel to a substrate surface.

2. The polymeric veneering panel of claim 1 further including one or more laminates, coatings or combinations thereof that are administered to the front surface and/or sides of the panel to provide natural surface color and/or texture.

3. The polymeric veneering panel of claim 2 wherein a coating including a solid surface coatings or polymer paint is administered to the front surface of the panel.

4. The polymeric veneering panel of claim 1 wherein the composite or polymeric material is selected from the group consisting of polyethylene, polypropylene, polyurethane, Acrylonitrile-butadiene-styrene (ABS), Poly(butylene terephthalate) (PBT), Poly(cyclohexanedimethylene terephthalate) (PCT), styrene-acrylonitrile copolymers (SAN), polystyrene, polycarbonate, polyester, thermosets and combinations and copolymers thereof.

5. The polymeric veneering panel of claim 1 wherein the one or more fasteners are selected from the group consisting of two sided tapes, sealants, screws, nails, rivets, and clipping devices.

6. The polymeric veneering panel of claim 1 wherein the front surface displays texture and relief from imaging the natural surface by casting or digital scanning the natural surface.

7. The polymeric veneering panel of claim 1 further including one or more tongues and one or more grooves for securing each panel to adjacent panels.

8. The polymeric veneering panel of claim 7 wherein the panel is secured to the substrate surface with a fastener selected from the group consisting of two sided tapes, sealants, screws, nails, rivets, and clipping devices.

9. The polymeric veneering panel of claim 1 wherein the panel is shaped in a Z-unit or T-unit configuration.

10. The polymeric veneering product of claim 6 wherein the natural surface is selected from the group consisting of stone, rock, wood, and brick.

11. The polymeric veneering product of claim 5 wherein the attachment platforms include one or more ridges and the clipping devices are bar clips.

12. The polymeric veneering product of claim 5 wherein the attachment platforms are sockets and the clipping devices are radius clips.

13. The polymeric veneering product of claim 1 wherein the hollow back surface is filled with a sound deadening and/or insulating material.

14. The polymeric veneering product of claim 13 wherein the sound deadening material is an insulation foam.

* * * * *